US005737931A

United States Patent [19]

Ueno et al.

[11] Patent Number: 5,737,931

[45] Date of Patent: Apr. 14, 1998

[54] REFRIGERANT CIRCULATING SYSTEM

[75] Inventors: Yoshio Ueno; Osamu Morimoto; Tomohiko Kasai; Yoshihiro Sumida, all of Tokyo, Japan

[73] Assignee: Mitsubishi Denki Kabushiki Kaisha, Tokyo, Japan

[21] Appl. No.: 668,155

[22] Filed: Jun. 21, 1996

[30] Foreign Application Priority Data

Jun. 23, 1995 [JP] Japan ..... 7-157870
Dec. 6, 1995 [JP] Japan ..... 7-318216

[51] Int. Cl.[6] ..... F25B 1/00; F25B 41/04

[52] U.S. Cl. ..... 62/126; 62/204; 62/502

[58] Field of Search ..... 62/126, 502, 228.4, 62/204

[56] References Cited

U.S. PATENT DOCUMENTS 5,353,604 10/1994 Oguni et al. ..... 62/502 X
5,410,887 5/1995 Urata et al. ..... 62/129

FOREIGN PATENT DOCUMENTS 6-12201 2/1994 Japan .
6-101912 4/1994 Japan .

*Primary Examiner*—William E. Wayner

*Attorney, Agent, or Firm*—Oblon, Spivak, McClelland, Maier & Neustadt, P.C.

[57] ABSTRACT

A refrigerant circulating system using non-azeothropic mixture as refrigerant, which comprises: a main refrigerant circuit connected by a compressor, a fore-way valve, an outdoor heat-exchanger, a first throttling device, a plurality of indoor heat-exchangers, and a low-pressure receiver; a bypass circuit diverging from the discharge portion of the compressor, and extending through a composition detecting heat-exchanger and a second throttling device to a low-pressure portion; an outdoor fun attendant of the outdoor heat-exchanger; first temperature detector to detect a refrigerant temperature at the upstream of the second throttling device; second temperature detector to detect a refrigerant temperature at the downstream of the second throttling device; first pressure detector to detect a pressure at the downstream of the second throttling device; third temperature detector to detect temperature in the main circuit between the first throttling device and the indoor heat-exchanger; forth temperature detector to detect temperature at the low-pressure portion; second pressure detector to detect the pressure at the high-pressure portion; a composition calculating device for calculating the composition of the mixture refrigerant; a main controller for controlling the number of rotation of the compressor and the number of rotation of an outdoor fun; a throttle controller for controlling the opening of the first throttling device.

20 Claims, 27 Drawing Sheets

REFRIGERANT CIRCULATING SYSTEM

BACKGROUND OF THE INVENTION

This invention relates to a refrigerant circulating system as used in refrigerating and air-conditioning systems, etc. in which mixture refrigerant such as non-azeotropic mixture refrigerant including hydro-fluoro-carbon as the principal ingredient is utilized.

FIG. 29 show a conventional refrigerating and conditioning system utilizing non-azeotropic mixture refrigerant, disclosed in Postexamined Japanese Patent Publication 6-12201, for example. In this Figure, reference numeral 1 identifies a compressor, 5 an indoor heat-exchanger, 4*a* and 4*b* main throttling devices, and 3 an outdoor heat-exchanger. These are arranged in a refrigerant piping to complete a main circuit for a refrigerating cycle. Reference numeral 29 represents a rectifying column to which column top portion a column top reservoir 31 is connected through a refrigerant pipe 50 and a refrigerant pipe 51 which includes a cooling source 30. To the bottom of the rectifying column 29, a column bottom reservoir 33 is connected through refrigerant pipe 52 and a refrigerant pipe 53 which includes a heating source 32.

A pipe extending between the main throttling devices 4*a* and 4*b* is separated to a refrigerant pipe 54 and a refrigerant pipe 55. The refrigerant pipe 54 includes a closing valve 34 and is connected to the column top reservoir 31, and the refrigerant pipe 55 includes a closing valve 36 and connected to the column bottom reservoir 33. The upstream side of the outdoor heat-exchanger 3 is connected to the column top reservoir 31 through a refrigerant pipe 56 mounting a sub throttling device 37 and a closing valve 38, and connected to the column bottom reservoir 33 through a refrigerant pipe 57 mounting the sub throttling device 37 and a closing valve 39. An outflow port of the column top reservoir 31 to the refrigerant pipe 56 is positioned at the bottom of the column top reservoir 31, and an outflow port of the column bottom reservoir 33 to the refrigerant pipe 57 is positioned at the bottom of the column bottom reservoir 33.

In the above-mentioned arrangement, high-temperature and high-pressure vapor of non-azeotropic mixture refrigerant (referred to simply as "refrigerant" hereinafter) compressed by the compressor 1 flows in the direction indicated by an arrow A, and is condensed by the indoor heat-exchanger 5, and thereafter enters into the main throttling device 4*a*. In a usual operation, the closing valves 34 and 35 are closed, and therefore the refrigerant directly enters into the main throttling device 4*b*, and the refrigerant which has made to a low-temperature and low-pressure condition is evaporated in the outdoor heat-exchanger 3 and then enters again into the compressor 1.

In case where the composition of the refrigerant which flows in this main circuit is changed, first to change the refrigerant flowing in the main circuit to that of the composition in which a high boiling-point component is included abundantly, the closing valves 38 and 34 are closed and the closing valves 39 and 36 are opened. Under these conditions, the refrigerant flow in the main circuit which goes out from the main throttling device 4*a* is divided so that a portion of the refrigerant flows in the closing valve 36 which is opened and the remainder flows in the main throttling device 4*b* in the same way as in the normal operation. The refrigerant which flowed in the closing valve 36 is then entered into the column bottom reservoir 33. A portion of the refrigerant which entered into the column bottom reservoir 33 then enters in the sub throttling device 37 through the closing valve 39 which is being opened, and thereafter joins the refrigerant flowing in the main circuit upstream with respect to the indoor heat-exchanger 5. The remainder of the refrigerant which entered into the column bottom reservoir 33 then enters in the refrigerant pipe 53 including the heating source 32 therein, and after heated it goes up within the rectifying column 29 in the form of vapor. At that time, refrigerant liquid reserved within the column top reservoir 31 flows in the refrigerant pipe 50 and goes down within the rectifying column 29 so that it is vapor-liquid contacted with the refrigerant vapor which is rising. As a result, so called rectification is carried out.

Thus, the density of the low boiling-point component in the refrigerant vapor increases as it rises within the rectifying column 29, and when introduced into the cooling source 30, it is liquefied. Then, the liquefied refrigerant is reserved within the column top reservoir 31 since the closing valve is closed. Such rectification is repeated, and finally, it follows that only the refrigerant with an abundance of the low boiling-point component is reserved within the column top reservoir 31. Therefore, the refrigerant flowing in the main circuit becomes one with the composition in which the high boiling-point component extremely abounds.

In order to change the refrigerant flowing in the main circuit to that of the composition in which a low boiling-point component is included abundantly, the closing valves 38 and 34 are opened and the closing valves 39 and 36 are opened. Under these conditions, the refrigerant flow in the main circuit which goes out from the main throttling device 4*a* is divided so that a portion of the refrigerant flows into the column top reservoir 31 through the closing valve 34 which is now opened, and then a portion of the refrigerant which flowed into the column top reservoir 31 flows in the closing valve 38 which is now opened, the refrigerant pipe 56 and the sub throttling valve 37 in turn and joins the refrigerant flowing in the main circuit. On the other hand, the remainder of the refrigerant which flowed into the column top reservoir 31 enters in the rectifying column 29 through the refrigerant pipe 50 and falls within the rectifying column 29. At that time, the liquid-phase refrigerant which is falling within the rectifying column 29 vapor-liquid contacts with a portion of the refrigerant reserved within the column bottom reservoir 33 which is then heated vaporized by the heating source 32 and rises within the cooling rectifying column 29, so that so called rectification is carried out. Thus, the density of the high boiling-point component in the refrigerant liquid falling within the cooling rectifying column 29 increases as it advances within the rectifying column 29. The resultant refrigerant liquid is reserved in the column bottom reservoir 33 since the closing valve 39 is closed. Such rectification is repeated, and finally, it follows that only the refrigerant with an abundance of the high boiling-point component is reserved within the column bottom reservoir 33. Therefore, the refrigerant flowing in the main circuit becomes one with the composition in which the low boiling-point component extremely abounds.

Incidentally, an example of means for component-detecting the composition of non-azeotropic mixture refrigerant in the refrigeration cycle directly from the refrigerant is disclosed in Unexamined Japanese Patent Publication 6-101912, for example.

In such prior art refrigerating and air-conditioning systems, since there is no means for detecting the composition of refrigerant as used, it is impossible to compute saturation temperature on the basis of the detection value of pressure, in case where circulation composition was changed. Therefore, for example, in a multi-type refrigerating and air-conditioning system in which flow control of refrigeration which circulates through a plurality of indoor machines is made, since the degree of opening of a throttling device is determined on the basis of the degree of supercooling or overheating of refrigerant at the entrance port of a heat exchanger, it is impossible to judge properly condensation temperature and evaporation temperature properly, which led to difficulty in distributing refrigerant to the respective indoor machines properly. Also, in a system in which the speed of rotation of a compressor and the speed of rotation of a outdoor fun are controlled to maintain condensation temperature and evaporation temperature constant, it is impossible to control the speeds of rotation of the compressor and outdoor fun properly to carry out high-efficiency operation.

Also, in a system in which control is made by measuring directly the composition of refrigerant, since measuring instruments must correspond with the various state of refrigerant, it is needed to use complicated instruments, and it is difficult to do measurement with high precision. Therefore, this system has many problems to be solved to put it to practical use.

SUMMARY OF THE INVENTION

This invention intends to estimate the composition of refrigerant which circulates through a refrigerant circuit and carry out control depending upon the estimated composition of refrigerant.

Also, this invention enables control depending upon an operation state.

This invention can solve the problems of the system having a plurality of indoor machines, and provides a high-precision system for maintaining the composition of refrigerant at all times.

Also, this invention provides a high-precision system which is practical and can be manufactured at a low price.

A refrigerant circulating system according to the invention comprises: a main refrigerant circuit for circulating mixture refrigerant, the main refrigerant circuit including a compressor, a directional control valve, a condenser, a first throttling device and an evaporator; a bypass circuit diverging from a point between the discharge portion of the compressor and the directional control valve, and connected through a composition detecting heat-exchanger and a second throttling device to a point between the intake portion of the compressor and the directional control valve; first temperature detecting means located to a point between the composition detecting heat-exchanger and the second throttling device, the first temperature detecting means detecting refrigerant temperature at the upstream of the second throttling device; second temperature detecting means located to a point between the composition detecting heat-exchanger and the second throttling device, the second temperature detecting means detecting refrigerant temperature at the downstream of the second throttling device; first pressure detecting means located at the intake side of the compressor, and for detecting the pressure of refrigerant at its located place; a composition calculating device for calculating the composition of mixture refrigerant on the basis of the detected refrigerant temperature and pressure; second pressure detecting means located at the discharge side of the compressor, and for detecting the pressure of refrigerant at its located place; and a main controller for controlling at least the number of rotation of the compressor or the number of rotation of a fun provided to the condenser or evaporator, on the basis of the calculated composition of refrigerant and detected pressure of refrigerant.

Accordingly, it is possible to construct an effective system in which dependability is high regardless of any operation manner, since the circulation composition is calculated to control the apparatus.

In the refrigerant circulating system, the main refrigerant circuit further includes a an accumulator, and the bypass circuit is to a point between the accumulator and the directional control valve. And, the refrigerant circulating system further comprises a third throttling device for coupling the high-pressure side inlet of the composition detecting heat-exchanger and the low-pressure side inlet of the composition detecting heat-exchanger.

Accordingly, since vibration at the connection point of the low-pressure side of the composition detecting heat-exchanger is low, dependability can be raised, and since the degree of overheat of the refrigerant which is sucked in the compressor becomes small, it is possible to construct an effective system.

In the refrigerant circulating system, the main refrigerant circuit is connected by a compressor, a directional control valve, an outdoor heat-exchanger, a first throttling device and an indoor heat-exchanger. The compressor, outdoor heat-exchanger and bypass circuit are housed within an outdoor machine.

Accordingly, since the bypass circuit is accommodated within the outdoor machine as well as the compressor and outdoor heat-exchanger, it is possible to obtain precise circulation composition, and provide a low-cost system with simple construction.

Further, the refrigerant circulating system according to the invention further comprises: a throttle controller for controlling the opening of the first throttling device; and a total controller including a timer and for controlling the control timings of the composition calculating device, main controller and throttle controller.

Accordingly, since the composition calculator, main controller and throttle controller are controlled in timing, it is possible to control them trackingly with good condition regardless of any change of the operating conditions, and to construct an effective system in which dependability is high.

Furthermore, the refrigerant circulating system according to the invention further comprises: third temperature detecting means for detecting temperature in the main circuit between the first throttling device and the indoor heat-exchanger; forth temperature detecting means for detecting temperature at the low-pressure portion; second pressure detecting means for detecting the pressure at the high-pressure portion; a composition calculating device for calculating the composition of each of components of mixture refrigerant; a main controller for controlling the number of rotation of the compressor or the number of rotation of an outdoor fun; a throttle controller for controlling the opening of the first throttling device; and a total controller including a timer and for controlling the control timings of the composition calculating device, main controller and throttle controller.

Accordingly, it is possible to detect circulation composition, calculate condensation temperature and evaporation temperature on the basis of the detected values of this circulation composition and the high-pressure and low-pressure, respectively, and control the number of rotation of the compressor, the number of rotation of the outdoor fun, the opening of the throttling device, etc. so that condensation temperature and evaporation temperature become constant. This enables the materialization of effective operation even when the operation condition changed the circulation composition.

Further, the refrigerant circulating system according to the invention is characterized in that the composition calculating device detects a physical quantity representative of an operational state of refrigerant circulation, and changes time interval for the composition calculation when the time change of the detected value is above a predetermined value.

By making the calculation timing of the circulation composition shorter, for example, when it is judged that the time change of a detected physical quantity is large, the composition can be detected following the change of composition in the unsteady condition to be able to carry out the control with desired circulation composition at all time, and the advantage of good controllability and reduced calculation load can be also attained.

Furthermore, the refrigerant circulating system according to the invention is characterized in that the control timing of the total controller is controlled on the basis of the time interval of the composition calculation of the composition calculating device.

It is possible to carry out the operation which is always based on the circulation composition, and to maintain system efficiency preferably.

Further, the refrigerant circulating system according to this invention is characterized in that the indoor heat-exchanger comprises a plurality of heat-exchangers adapted to be operated so that a part thereof is in operation and the other is not in operation.

In accordance with the invention, it is possible to distribute reliably refrigerant even when some of the indoor machines were stopped, and to construct a dependable and effective system.

Further, the refrigerant circulating system according to the invention is characterized in that the second throttling device and a pipe portion between the second throttling device and the composition detecting heat-exchanger are heat-isolated.

By heat-isolating the second throttling device and the pipes before and behind it and by prohibiting mutual delivery of heat between the throttling portion and the surrounding air, the refrigerant acts the sure behavior of equi-enthalpy change in the throttling portion, and therefor it is possible to improve accuracy in sensing the circulation composition.

Further, the refrigerant circulating system according to the invention is characterized in that the circulation composition obtained through the calculation of the composition calculating device is compensated for with respect to the outside air temperature.

By determining the amount of heat exchange between the outside on the basis of the outside air temperature, and carrying out compensation to the composition calculated, it is possible to seek the circulation composition with precision regardless of change of the outside air, and to improve composition detecting accuracy with low cost.

Further, the refrigerant circulating system according to of this invention is characterized in that a first throttling device for a indoor machine which is not in operation is controlled to have a predetermined opening at the time of the heating operation.

In accordance with the invention, by controlling a throttling device of a halted indoor machine with its appropriate opening to prevent collection of refrigerant in the halted indoor machine and to restrain variation of the circulation composition, since the refrigerating cycle can be controlled with the composition which was caused to be stabilized at all time, it is also possible to carry out the calculation with controllable and effective circulation composition.

Further, the refrigerant circulating system according to this invention is characterized in that a first throttling device for a indoor machine which is not in operation is controlled to be closed at the time of the heating operation.

In accordance with the invention, by entirely releasing the opening of a throttling device for a halted indoor machine, since refrigerant to be circulated through indoor machines which are in operation does not circulate in the halted indoor machine, and the entire refrigerant flowing through the main circuit exchanges heat in the indoor machines which are in operation, it is possible to operate the system efficiently.

Further, the refrigerant circulating system according to this invention is characterized in that a first throttling device for a indoor machine which is not in operation is controlled in its opening on the basis of the liquid level within a liquid reservoir provided at the low-pressure portion of the refrigerant circulating system.

In accordance with the invention, by controlling a throttling device for a stopped indoor machine in its opening on the basis of the liquid level of the refrigerant liquid, since the variation of circulation can be restrained and the refrigerating cycle can be controlled with the composition which was caused to be stabilized, it is possible to provide a controllable and effective system.

Further, the refrigerant circulating system according to this invention is characterized in that a respective first throttling device for a respective indoor machine which is not in operation is controlled so that it is opened at different timings, when refrigerant resident in the indoor machines which are not in operation is returned to the main circuit.

In accordance with the invention, when liquid refrigerant residing in a plurality of halted indoor machines is returned to the main circuit, by collect it from the respective halted indoor machines individually at different timings, it is possible to restrain rapid change of the liquid level within the low-pressure receiver. Therefore, since the resulting rapid change of composition can be avoided, dependability of the refrigerating and air-conditioning system itself can be raised, and it is possible to operate the system with efficient circulation composition.

Further the refrigerant circulating system according to the invention is characterized in that the refrigerant circulating system includes a safety device for examining whether the composition calculated by the composition calculating device is within a range of a predetermined composition and stooping the unit when the examination showed that the detected composition is not within a proper range, and/or a display device for displaying the composition when its abnormality was detected.

When the composition which was detected exceeds a predetermined range of composition, the units can be stopped, and the circulation composition which is composed at that time can be displayed. Therefore, it is possible to raise safety and improve serviceability.

In the refrigerant circulating system, the main refrigerant circuit further includes an oil separator, the a bypass circuit is diverged from a point between the oil separator and the directional control valve, and a third throttling device is provided to couple the high-pressure side inlet of the composition detecting heat-exchanger to the low-pressure side outlet of the composition detecting heat-exchanger.

In accordance with the invention defined by claim 16, since the degree of overcooling of refrigerant at the inlet of the second throttling device is easy to be secured, it is possible to make wider the range within which the circulation composition can be detected, and since oil which flows into the bypass circuit is small, it is possible to carry out the detection of circulation composition in a always stabilized condition.

Further, the refrigerant circulating system according to this invention is characterized in that the second pressure detecting means is located on a pipe connecting the inlet portion of the compressor and the directional control valve which is located at the connection of the low-pressure side of the composition detecting heat-exchanger to the pipe connecting the inlet portion of the compressor and the directional control valve.

In accordance with the invention, it is possible to detect the circulation composition with high precision and in a always stabilized condition, since there is no influence from pulsation at the bypass circuit.

Further, the refrigerant circulating system according to this invention is characterized in that the second temperature detecting means is located to be separated from the second throttling device by at least a distance corresponding to pipe length through which the flow of two-phase refrigerant develops.

In accordance with the invention, since the temperature of the low-pressure two-phase refrigerant in the bypass circuit can be detected with precision, it is possible to raise detection accuracy for the circulation composition.

Further, the refrigerant circulating system according to this invention is characterized in that pressure loss at the low-pressure side of the composition detecting heat-exchanger is set such that pressure at a low-pressure pressure sensor is substantially coincident with pressure at the inlet portion of the compressor.

In accordance with the invention, since the outlet pressure of the second throttling device is coincident with the low-pressure side output, it is possible to raise detection accuracy for the circulation composition this enables effective control.

Further, the refrigerant circulating system according to the invention further comprises: a low-pressure side pressure loss calculating device for the composition detecting heat-exchanger.

In accordance with the invention, since the outlet pressure of the second throttling device and the low-pressure side output can be detected, it is possible to raise detection accuracy for the circulation composition. This enables effective control.

Further, the refrigerant circulating system according to the invention further comprises: a composition regulating operation controller providing an operation state in which the circulation composition is pre-known; and a composition compensating value calculating device for calculating difference between the composition value calculated at that time and a pre-known circulation composition; and is characterized in that the composition calculated in the composition calculating device is compensated for on the basis of the composition compensating value which has sought at the time of the composition regulating operation.

Since the circulation composition calculated value can be compensated for to a suitable value, it is possible to raise detection accuracy for the circulation composition.

DETAILED DESCRIPTION OF PREFERRED EMBODIMENTS

Embodiment 1

Figure 1:
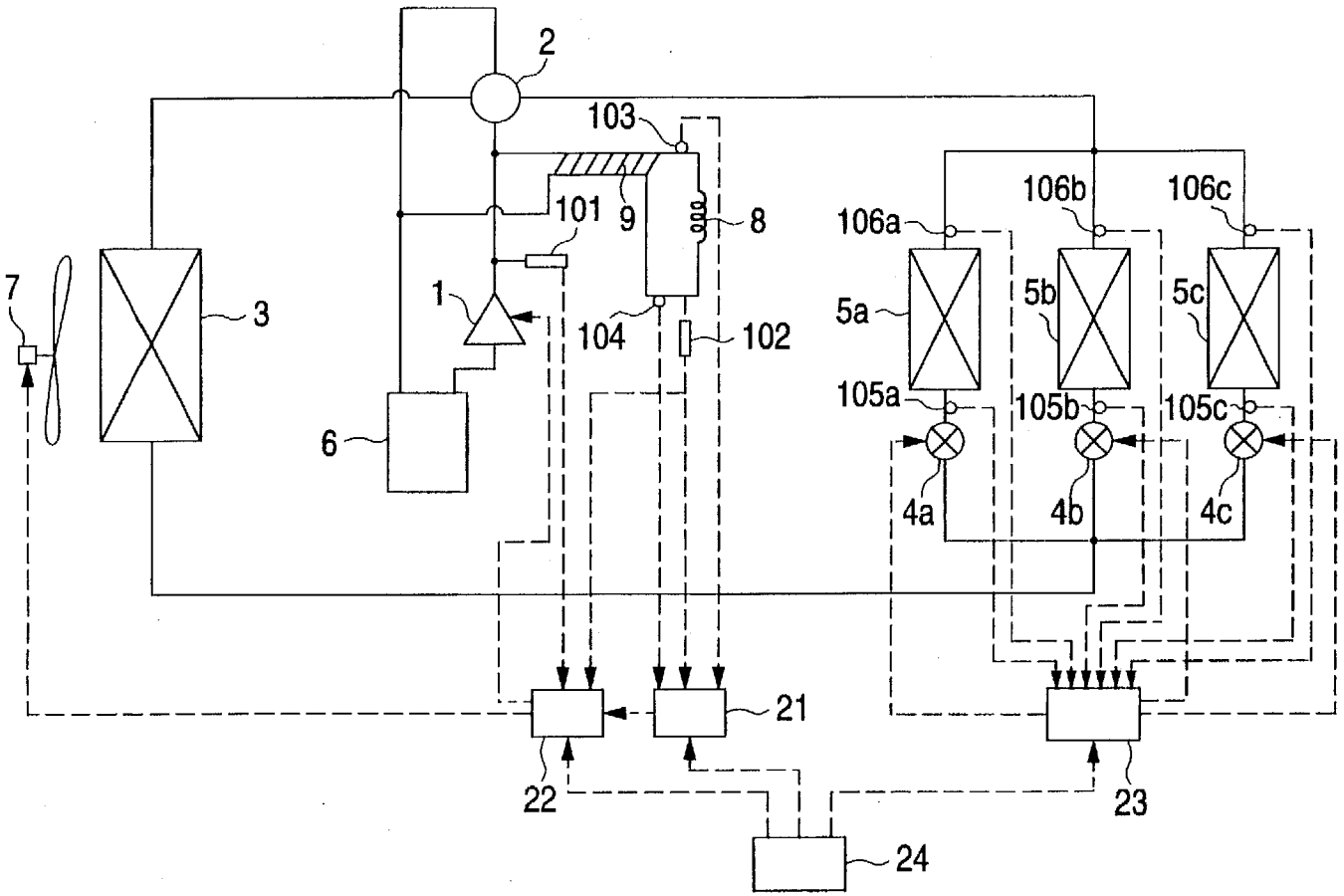
FIG. 1 is a refrigerant circuit diagram of a refrigerating and air-conditioning system according to a first embodiment of this invention.
Figure 2:
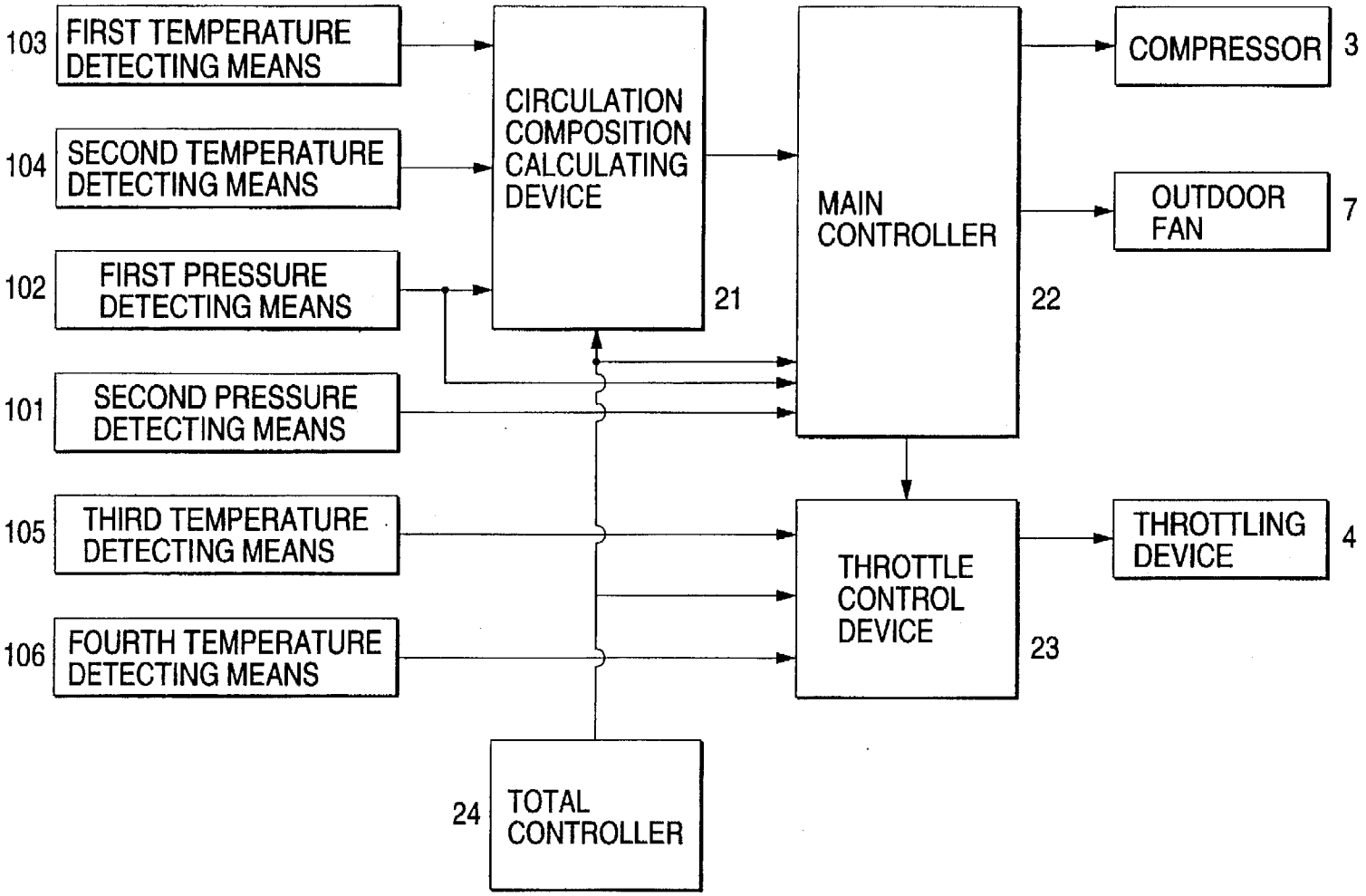
FIG. 2 is a block diagram showing a control operation of the system of the first embodiment.

Hereinafter, a first embodiment of this invention will be explained referring to FIGS. 1 and 2. FIG. 1 is a view showing a system for a refrigerating cycle according to the first embodiment of this invention, and FIG. 2 shows in detail its control part. In this embodiment, a multi-type air-conditioning machine is materialized having three indoor machines a, b and c. In FIG. 1, reference number 1 identifies a compressor, 2 a four-way valve which acts as a directional control valve, 3 an outdoor heat-exchanger, 4 first throttling devices, 5 indoor heat-exchangers, and 6 a low-pressure receiver. These are connected by refrigerant pipes to complete a main circuit. In the arrangement, there are three first throttling devices 4*a*, 4*b* and 4*c*, and three indoor heat-exchangers 5*a*, 5*b* and 5*c*. Reference numeral 8 indicates a second throttling device and 9 a composition detecting heat-exchanger. These are connected to each other by a refrigerant pipe of which one end is connected to a discharge pipe for the compressor 1, and of which other end is connected to a refrigerant pipe between the four-way valve 4 and accumulator (also referred to as a low-pressure receiver) 6, which constitute low-pressure parts, thereby to form a bypass circuit. The compressor 1 and an outdoor fan 7 are of a type of the variable speed of rotation. Incidentally, while, in the illustrated example, the bypass circuit is connected to the low-pressure part between the four-way valve 2 and the low-pressure receiver 6, it may be connected to any one of the low-pressure parts.

However, in case where the low-pressure outlet port of the composition detecting heat-exchanger 9 is connected to the inlet pipe of the compressor 1, the connected portion of the outlet port to the inlet pipe is liable to be damaged by vibration of the compressor 1. Also, since the degree of overheating of the refrigerant flowing out from the low-pressure outlet port of the composition detecting heat-exchanger 9 is great, if the compressor 1 inhales this refrigerant directly, the system exerts a bad influence on its performance (for example, a rise in discharge temperature). Therefore, to ensure reliability and performance, it is favorable to connect the low-pressure outlet port of the composition detecting heat-exchanger 9 to the pipe between the four-way valve 2 and the low-pressure receiver 6. That is, the bypass circuit having the composition detecting heat-exchanger and the second throttling device is provided between a high-pressure part and a low-pressure part which is located between the accumulator and the directional control valve, and at least the speed of rotation of the compressor or the speed of rotation of the fan provided in a condenser or evaporator is controlled and the computed composition of refrigerant and the detected pressure of refrigerant remain at levels which ensure reliability and performance.

Incidentally, the compressor 1, the four-way valve 2, the outdoor heat-exchanger 3, the low-pressure receiver 6, the second throttling device 8, the composition detecting heat-exchanger 9 and the bypass circuit may be accommodated in the outdoor machine collectively to make the structure simpler.

Reference numeral 101 identifies second pressure detecting means for detecting the discharge pressure of the compressor 1, and 102 first pressure detecting means for detecting pressure at the downstream position of the second throttling device 8. Reference numerals 103 and 104 identify first and second temperature detecting means for detecting temperatures at the upstream and downstream positions of the second throttling device 8, respectively.

It is needed that the position of the second temperature detecting means be separated by at least 50 mm from the second throttling device 8. This is because it is impossible to detect the temperature of two-phase refrigerant with accuracy directly after the outlet of the second throttling device 8 since the flow of the two-phase refrigerant is underdeveloped at this position. Incidentally, the value of 50 mm is selected to correspond with the second throttling device of $\phi 2.4 \times t0.8$ (2.4 mm diameter and 0.8 mm thickness) and the bypass pipe of $\phi 6.35 \times t0.8$. These values depend upon the size and shape of the pipe.

Directly after the flow was changed by the throttling device, some inlet distance sufficient to develop the flow is needed.

When the flow has developed, since the thermal conductivity of refrigerant is large, the temperature of the refrigerant becomes substantially equal to the temperature of the pipe, making an error of temperature measurement smaller.

On the other hand, if the flow has not fully developed after the flow was changed, the error of temperature measurement becomes larger. Also, since in this underdeveloped area, pressure pulsation is likely produced, it is needed to separate a low-pressure pressure sensor sufficiently from the flow changing area.

Reference numeral 105 identifies third temperature detecting means for detecting temperature between a first throttling device 4 and a indoor heat-exchanger 5, and 106 forth temperature detecting means for detecting temperature of a pipe acting as an outlet in cooling operation. Reference numeral 21 identifies a composition calculating device for calculating the composition of refrigerant which circulates within the refrigerant circuit on the basis of the detected values from the first temperature detecting means 103, second temperature detecting means 104 and first pressure detecting means 102. Reference numeral 22 indicates a main controller for determining the speeds of rotation of the compressor 1 and outdoor fun 7 and controlling the same, on the basis of a calculation result from the composition calculating device 21 and the detected values from the first pressure detecting means 102 and second pressure detecting means 101. Reference numeral 23 identifies throttle controlling means for determining the opening of the first throttling device 4 to control the same. Reference numeral 24 is a total control device including a timer and controlling the control timing of the composition calculating device 21, main controller 22 and throttle control device 23.

Since the temperature detecting means merely detect the temperature of refrigerant, they may detect the temperature of the pipes in place of refrigerant flowing through the pipe.

Next, the operation of the apparatus will be explained. At the time of the cooling operation, refrigerant which discharged from the compressor 1 flows into the outdoor heat-exchanger 3 through the four-way valve 2, where it radiates heat around and condenses. Condensed liquid refrigerant which is under high pressure is choked by the first throttling devices 4 so that it changes into gas-liquid two-phase refrigerant which is under low temperature and low pressure, and flows into the indoor heat-exchangers 5. The gas-liquid two-phase refrigerant of low temperature and low pressure which entered into the indoor heat-exchangers 5 absorbs ambient heat for cooling, vaporizes and returns to the compressor 1 through the four-way valve 2 and low-pressure receiver 6.

Next, the flow of refrigerant in the heating operation of the apparatus will be explained. Refrigerant which discharged from the compressor 1 flows into the indoor heat-exchangers 5 through the four-way valve 2, where it radiates heat around for heating and condenses. Condensed liquid refrigerant which is under high pressure is choked by the first throttling devices 4 so that it changes into gas-liquid two-phase refrigerant which is under low temperature and low pressure, and flows into the outdoor heat-exchanger 3. The gas-liquid two-phase refrigerant of low temperature and low pressure which entered into the outdoor heat-exchanger 3 absorbs ambient heat, vaporizes and returns to the compressor 1 through the four-way valve 2 and low-pressure receiver 6.

Figure 3:
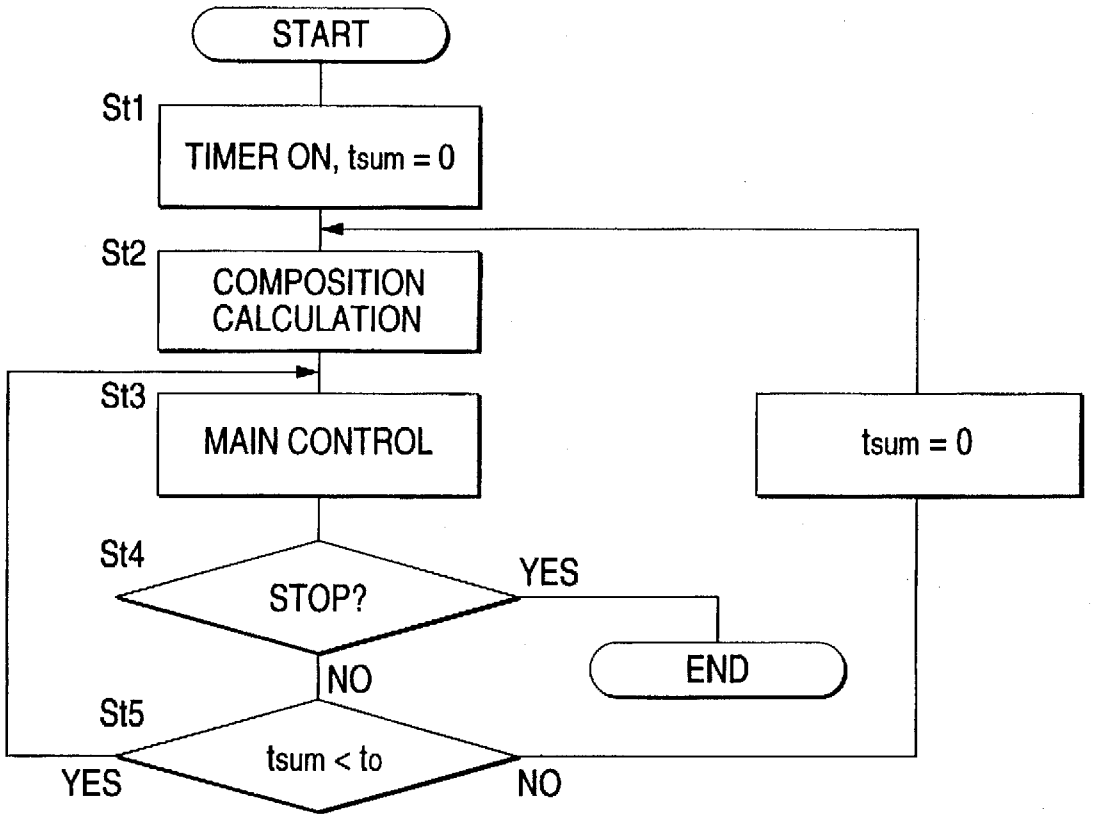
FIG. 3 is a flow chart showing a flow of control made by a total controller in the first embodiment.

Next, the operation of the total controller 24 will be explained. FIG. 3 is a flow chart showing the control of the total controller 24. In step (hereunder refer to st1) 1, the timer is activated and the total time from the starting time of the compressor, $t_{sum}$ is set to 0, that is $t_{sum}=0$. In st2, a command is given to the composition calculating device 21 so that circulation composition is calculated. After this calculation was made in the composition calculating device 21, control is shifted to st3 in which a command is issued for the main controller 22 to control the speed of rotation of the compressor 1 and the speed of rotation of the outdoor fun 7. In st4, the units are stopped when unit stop conditions are satisfied. However, if they are not satisfied, control is shifted to st5 in which the total time $t_{sum}$ is compared to a predetermined composition calculation timing $t_0$. If $t_{sum}<t_0$, only the main control is carried out without the composition calculation. If $t_{sum}>t_0$ and $t_{sum}=t_0$, $t_{sum}$ is reset to zero, the composition calculation is made.

Figure 4:
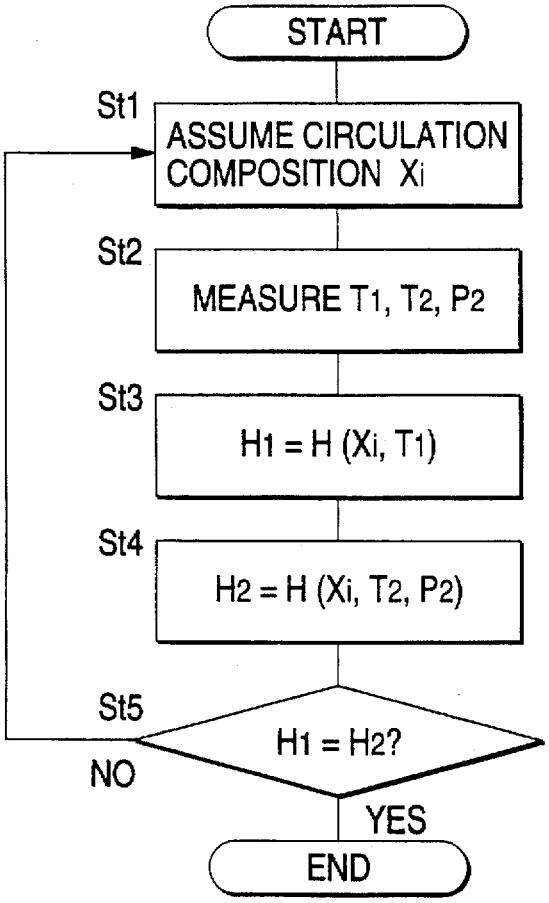
FIG. 4 is a flow chart showing a flow of composition calculation made by the system of the first embodiment.

Next, the operation of the composition calculating device 21 will be explained. FIG. 4 is a flow chart showing the flow of the composition calculation. In the process of the composition calculation, for a respective component of mixture refrigerant its composition $x_i$ is assumed in st1. In st2, detected values $T_1$, $T_2$ and $P_2$ from the first temperature detecting means 103, second temperature detecting means 104 and first pressure detecting means 102, respectively are measured. In st3, high-pressure liquid enthalpy $H_1$ is calculated on the basis of the circulation composition $x_i$ assumed in st1 and the temperature detected value $T_1$. In st4, low-pressure two-phase enthalpy H2 is calculated on the basis of the circulation composition $x_i$, the temperature detected value $T_2$ and the pressure detected value $P_2$. In st5, $H_1$ and $H_2$ thus calculated are compared with each other, and the assumption of the circulation composition is repeated until they become equal. A value of $x_i$ at the time when $H_1$ and $H_2$ became equal is determined as the circulation composition. In the above-mentioned explanation, suffix i means refrigerant in case where i kinds of components are mixed.

Incidentally, in the illustrated embodiment, the first pressure detecting means 103 which is a low-pressure pressure sensor is shown connected between the composition sensing heat-exchanger 9 and the second throttling device 8 so that the most accurate measurement can be obtained. However, it may be located at any place in the low pressure portion.

It is needed to provide such condition that pressure at the low-pressure pressure sensor shall substantially coincide with pressure at the inlet portion of the compressor 1 to control effectively the compressor frequency. To this end, pressure loss at the low-pressure side of the composition detecting heat-exchanger 9 must be small under 0.2 kgf/cm$^2$, for example.

The low-pressure side at which this pressure sensor is mounted means a portion from the outlet of the second throttling device 8 to a low-pressure pipe which joins to the bypass circuit.

Since cooling capacity of a unit is determined by the absorption pressure of the compressor, that is the inlet pressure of the accumulator 6, sufficient cooling capacity can be ensured if the compressor frequency is controlled so that its pressure becomes a target value.

Therefore, as mentioned above, in case where pressure at the low-pressure pressure sensor is substantially coincident with the compressor inlet pressure, sufficient cooling capacity can be ensured by controlling the unit by the value of the low-pressure pressure sensor, that is the outlet pressure of the second throttling device 8.

Figure 5:
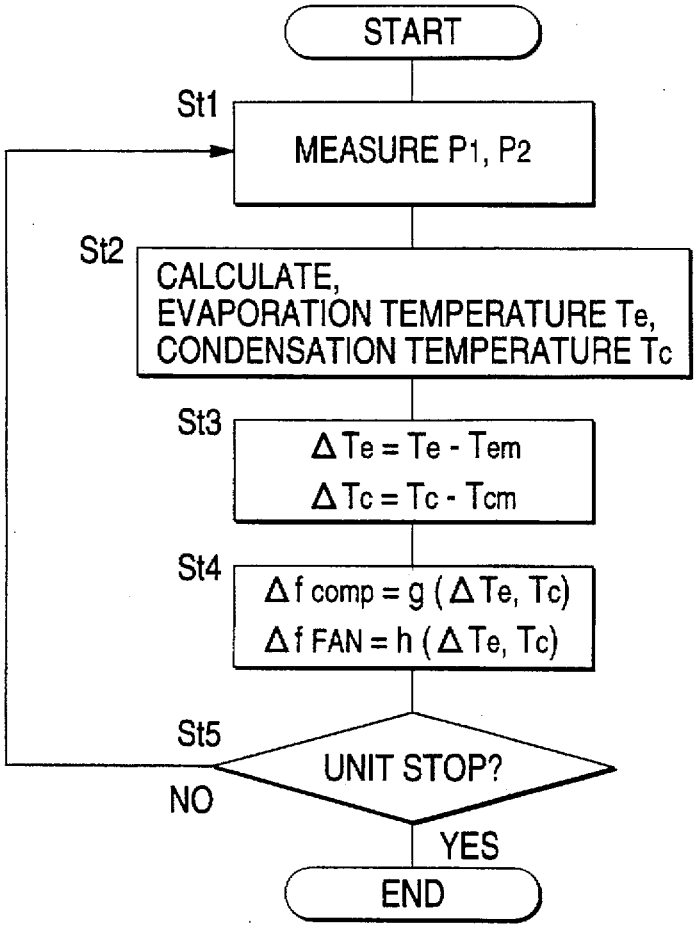
FIG. 5 is a flow chart showing a flow of control made by a main controller in the first embodiment.

Next, the function of the main controller 22 will be explained. FIG. 5 is a flow chart showing the flow of the control of the main controller 22. In st1, high-pressure pressure $P_1$ to be detected by the second pressure means 101 and low-pressure pressure $P_2$ are measured. In st2, condensation temperature Tc is calculated on the basis of the high-pressure pressure $P_1$ and the circulation composition calculated in the composition calculating device 21, and also evaporation temperature Te is calculated on the basis of the low-pressure pressure P2 and the circulation composition calculated in the composition calculating device 21. In st3, difference ΔTc between predetermined target condensation temperature Tcm and the condensation temperature Tc and difference ΔTe between predetermined target temperature Tem and the evaporation temperature Te are calculated. In st4, change width $\Delta f_{comp}$ of the number of rotation of the compressor and change width $\Delta f_{FUN}$ of the number of rotation of the outdoor fun are determined depending upon the magnitudes of ΔTc and ΔTe to change the number of rotation for the compressor and outdoor fun.

Figure 6:
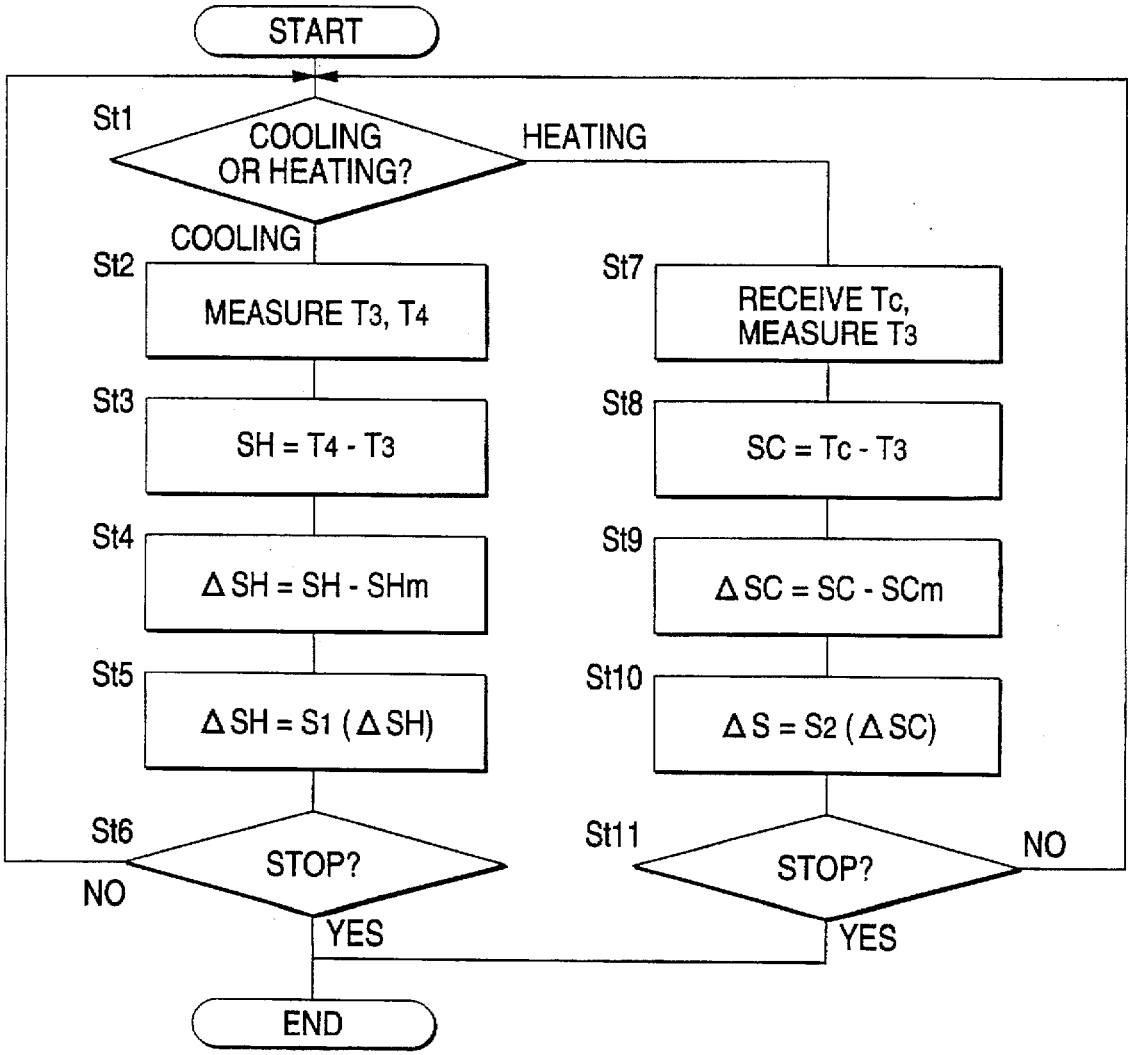
FIG. 6 is a flow chart showing a flow of control made by a throttle controller in the first embodiment.

Next, the function of the throttle controller 23 will be explained. FIG. 6 is a flow chart for the control of the throttle controller 23. In st1, a decision is made as to whether the operation is in cooling or heating. If the operation is in cooling, a process in st2 is executed, that is temperatures $T_3$ and $T_4$ are detected by the third temperature detecting means 105 and the fourth temperature detecting means 106, respectively. In st3, difference SH between $T_3$ and $T_4$ is calculated. In st4, difference ΔSH between a predetermined target value SHm and the SH is calculated. In st5, change width ΔS of the opening of a throttling device is calculated depending upon the magnitude of the ΔSH and the change of the opening of the throttling device is effected. In st6, when stop conditions are satisfied, the indoor machine is set to stop, and when they are not satisfied, the process is returned to st1.

In the case of the heating operation, the process shifts to st7 in which temperature $T_3$ is measured by the third temperature detecting means 105 and the condensation temperature Tc from the main controller is received. In st8, difference SC between Tc and $T_3$ is calculated. In st9, difference ΔSC between a predetermined target value Scm and the SC is calculated. In st10, change width ΔS of the opening of a throttling device is calculated depending upon the magnitude of the ΔSC and the change of the opening of the throttling device is effected. In st11, when stop conditions are satisfied, the indoor machine is set to stop, and when they are not satisfied, the process is returned to st1.

The condensation temperature and evaporation temperature are calculated on the basis of the composition calculated in the composition calculating device, the pressure $P_1$ at the high-pressure portion and the pressure $P_2$ at the low-pressure portion. Further, the number of rotation of the compressor and the number of rotation of the outdoor fun are determined depending upon the deference between the predetermined target condensation temperature and the calculated condensation temperature and the difference between the predetermined evaporation temperature and the calculated evaporation temperature.

That is to say, in the above explanation, the throttling device control part detects temperatures at the inlet and outlet of an indoor heat-exchanger at the time of the cooling operation. Further, the opening of the first throttling device is set so that the difference between the temperatures at the inlet and outlet of the indoor heat-exchanger becomes constant. Also, at the time of the heating operation, the condensation temperature calculated in the main controller is utilized and the temperature at the refrigerant pipe between an indoor heat-exchanger and the throttling device is detected. Further, the opening of the first throttling device is set so that the temperature difference between the calculated condensation temperature and the detected refrigerant pipe temperature becomes constant.

In the total control part, the timings of the composition calculation, main control and throttle control are conditioned. This enables the control in response to the composition even if the circulation composition changes in a multi-type refrigerating and air-conditioning system, and therefore an efficient operation for the system can be realized.

In accordance with the above-mentioned function, in a multi-type refrigerating and air-conditioning system wherein the condensation temperature and evaporation temperature are calculated on the basis of the detected pressure value, and the opening of a first throttling device 4, the number of rotation of the compressor 1 and the number of rotation of the outdoor fun 7 are controlled on the basis of the calculated condensation temperature and evaporation temperature, it is possible to hold properly the number of rotation of the compressor 1, the number of rotation of the outdoor fun 7 and the opening of the first throttling device 4, even though the composition of refrigerant circulating through the refrigerant circuit is changed with the change of operating conditions. Therefore, in a heat-exchanger, it is possible to hold properly the evaporation temperature and condensation temperature and to distribute properly refrigerant to each indoor machine, whereby the evaporation temperature, condensation temperature, evaporator outlet degree-of-superheating and condenser outlet degree-of-supercooling can be maintained within a desired design limit, and an efficient operation can be ensured.

In the arrangement in FIG. 1, the composition detecting heat-exchanger 9 is connected at its one end to the pipe coupled between the discharge side of the compressor 1 and the four-way valve 2, and at the other end to the pipe coupled between the return side of the compressor 1 and the four-way valve 2.

This provides convenient means by which the composition detecting heat-exchanger 9 can detect the composition with its connections to the high-pressure side and low-pressure side not changed, even when the four-way valve switches the operation to the cooling or heating mode.

The composition calculating device 21 may be included within the indoor machine side, but it is convenient for it to be included within the outdoor machine when it is considered that the calculation can be made by the same circuit in both the cooling and heating modes.

Further, the elements of the bypass circuit 15 can be located together between the compressor 1 and the four-way valve 2. For example, they may be accommodated within a box for the outdoor machine of the air-conditioning system so that the pipes of the bypass circuit can be shortened. This makes it hard to receive an influence of heat from the outside, thereby providing a simple arrangement by which detecting accuracy can be held satisfyingly.

Figure 21A:
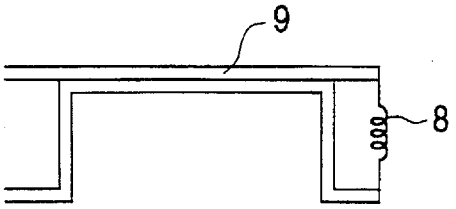
FIGS. 21A, 21B are explanatory views showing the structure of a composition detecting heat-exchanger as used in this invention.
Figure 21B:
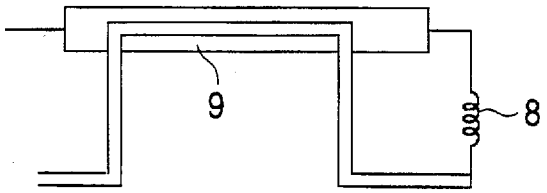

The throttling device 8 used as the bypass tube may be a closing valve or a capillary tube, but it is preferable to make it thinner within the limits of refrigerant passage therethrough, because it makes capacity reduction based on refrigerant bypass smaller. FIG. 21 shows the construction of this composition detecting heat-exchanger. In a contact type shown in FIG. 21(*a*), the pipes are contacted to each other to effect heat exchange, and in a duplex tube type shown in FIG. 21(*b*), heat exchange is effected between its inner tube and outer tube.

In the composition detecting heat-exchanger of the duplex tube type, such an arrangement that the high-pressure pipe is the outer tube is effective in radiating heat around, this promoting condensation of refrigerant.

The use of the capillary tube makes the second throttling device 8 cheaper. An electronic expansion valve may be used. In the above-mentioned description, the embodiment was explained to include a plurality of indoor heat-exchangers, but a single indoor heat-exchanger may be utilized. If a plurality of indoor heat-exchangers are used and some of them are in operation with the remainder being in a dormant state, refrigerant is gradually accumulated in the machines which are halted, resulting in "puddle" of refrigerant. In this case, the composition of the refrigerant in the refrigerating cycle is changed.

In this invention, the main controller 22 controls the compressor, the fan, and the electronic expansion valve such as a closing valve to control the refrigerating cycle to a predetermined condition and maintain the operation in that condition.

Incidentally, in the case of the control of only the compressor, from a viewpoint of protection, it is judged that the low-pressure is too low, and control is made to reduce the frequency of the compressor. Also, in the high-pressure control at the time of cooling and the low-pressure control at the time of heating, only the fun is controlled on the base of the outdoor air temperature and the composition to determine the number of rotation of the fun so that the operation is made depending thereupon.

Embodiment 2

Hereinafter, a second embodiment of this invention will be explained referring to FIG. 7.

In this embodiment, since the constitutions and functions of a refrigerant circuit, a main controller 22, a composition calculating device 21 and a throttle controller 23 are the same as those in the first embodiment, their explanation is omitted.

Figure 7:
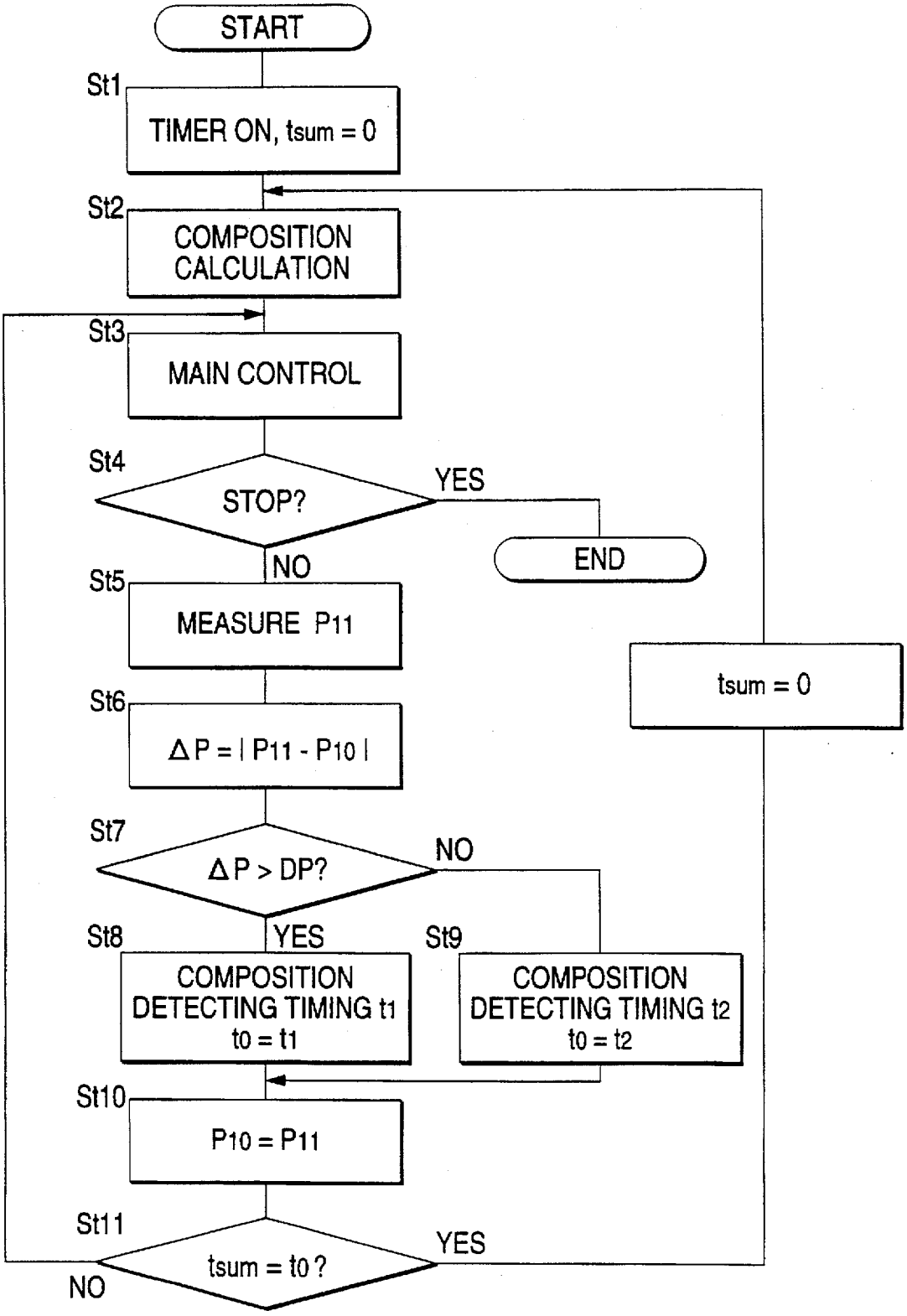
FIG. 7 is a flow chart showing a flow of control made by a total controller in a second embodiment of this invention.

FIG. 7 is a flow chart showing the function of the total controller 24 in this embodiment. In st1, a timer is started and integrated time is set to zero, that is $t_{sum}=0$. In st2, the composition calculating device 21 is commanded to calculate circulation composition. When the composition is calculated in the composition calculating device 21, the process is shifted to st3 in which a command that the main controller 22 controls the number of rotation of the compressor 1 and the number of rotation of the outdoor fun 7. In st4, when a unit stop condition is satisfied, the units are stopped, and when the unit stop condition is not satisfied, the process is shifted to st5. In st5, current high-pressure pressure $P_{11}$ is detected. In st6, difference $\Delta P$ between $P_{11}$ and the preceding high-pressure pressure $P_{10}$ is calculated. In st7, $\Delta P$ is compared with a predetermined pressure change width DP. If $\Delta P>DP$, an unsteady state is determined, and the process is shifted to st8 in which the time of control timing is set to $t_1$. However, if $\Delta P<DP$, a steady state is determined, and the process is shifted to st9 in which the time if control timing is set to $t_2$. In st10, the recently detected high-pressure pressure is stored with $P_{10}=P_{11}$. In st11, the integrated time $t_{sum}$ is compared with predetermined composition calculation timing $t_0$. If $t_{sum}<t_0$, the composition calculation is not carried out. However, if $t_{sum}>t_0$ or $t_{sum}=t_0$, $t_{sum}$ is reset to zero, that is $t_{sum}=0$, and the composition calculation is effected.

In accordance with the above-mentioned effect, it is possible to increase reliability in control in the unsteady states at the time of the activation of the units, the change of the number of operated indoor machines, and after the change of the operation mode, etc., by shortening timing in the detection of the circulation composition and following the control to the change of the circulation composition in such unsteady states.

In the above explanation, the steady state and unsteady state was determined by the pressure detection. However, this determination may be made indirectly by temperature detection, for example. That is, a detectable method may be employed from the viewpoint as to whether or not an intense change in composition is liable to occur.

For example, in case where operation is liable to vary because of load fluctuation, the motion of refrigerant becomes unstable because of pressure fluctuation, and the composition is liable to change. In such case, it is possible to obtain stable composition by controlling the apparatus to shorten composition detecting timing since the time change of the composition becomes large, and therefore the ability of the machines using the refrigeration cycle can be maintained suitably. The timing at when composition is detected and the machines are control is on a level of several minutes in the steady state, but in the unsteady states it is decreased to about several tens of seconds through about one minute. Also, in the case of the unsteady state in which it is not needed to use the whole ability as in the time of the starting, it is possible to avoid useless operation by detecting the composition at the timing of several minutes through ten odd minutes, which elongates the life of the machines and prevents abnormal operation of the machines.

Embodiment 3

Hereinafter, a third embodiment of this invention will be explained referring to FIG. 8.

In this embodiment, since the constitutions and functions of a total controller 24, a main controller 22, a composition calculating device 21 and a throttle controller 23 are the same as those in the first embodiment, their explanation is omitted.

Figure 8:
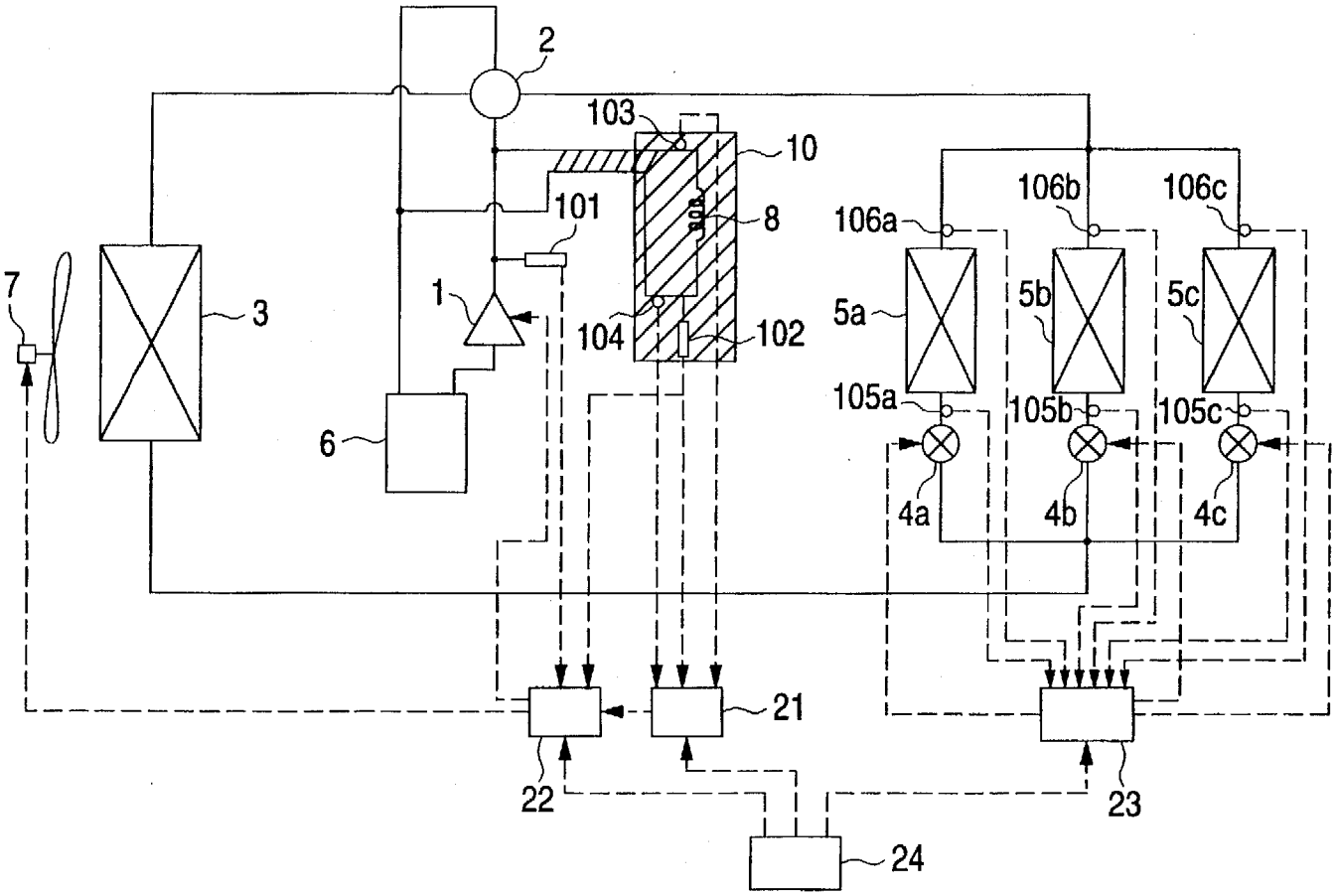
FIG. 8 is a refrigerant circuit diagram of a refrigerating and air-conditioning system according to a third embodiment of this invention.

FIG. 8 is a refrigerant circuit showing the third embodiment of this invention. In the Figure, to the same elements as those in the first embodiment, the same reference numerals are affixed, and their explanation is omitted. In this embodiment, a heat insulator 10 is utilized to cover a second throttling device 8 and pipes between it and a composition detecting heat-exchanger 9, in a similar refrigerant circuit to that of the first embodiment in FIG. 1.

With the function of the heat insulator 10, the second throttling device 8 and the pipe portions before and behind it are isolated from a delivery relationship of heat between them and the outside air, and in the second throttling device 8 and before and behind it, refrigerant have the sure behavior of equi-enthalpy change. Therefore, in composition calculation, it is possible to calculate correctly high-pressure liquid enthalpy $H_1$ and low-pressure two-phase enthalpy $H_2$ to improve composition calculation accuracy.

Figure 22A:
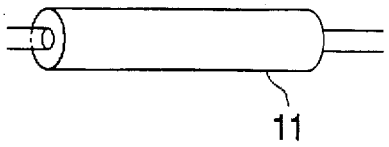
FIGS. 22A, 22B are explanatory view for explaining a structure in which a second throttling device and pipes therefor are covered by heat isolating material.
Figure 22B:
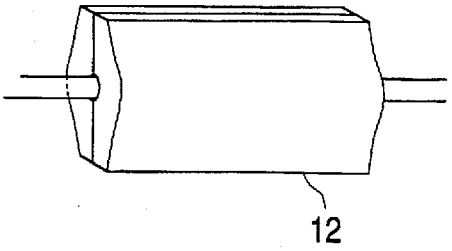

FIG. 22 shows two examples of the heat insulator 10. In FIG. 22(*a*), glass wool 11 is used as the heat insulator, with which the heat-isolated objects are rolled. In FIG. 22(*b*), soft tapes (foam material) 12 are used as the heat insulator, which put the heat-isolated objects therebetween. In order to provide more certain temperature detection, sensors 103 and 104 such as thermistors which are temperature detectors attached to the pipes through suitable holders may be also wrapped in the heat insulator. Also, for the same purpose, pressure detecting means 102 for detecting the pressure of refrigerant within the bypass tube may be wrapped in the heat insulator.

Incidentally, the above explanation does not touch upon the point that the composition detecting heat-exchanger is covered by the heat insulator, from the viewpoint that it is better that it should not be covered by the heat insulator because at the high-pressure side positive heat radiation to the ambient atmosphere helps the condensation of refrigerant. However, if it is constituted in such a manner that heat isolation becomes effective, the heat-exchanger portion may be heat-isolated as a matter of course.

Embodiment 4

Hereinafter, a forth embodiment of this invention will be explained referring to FIGS. 9, 10 and 11.

In this embodiment, the constitutions and functions of a total controller 24, a main controller 22 and a throttle controller 23 are the same as those in the first embodiment.

Figure 9:
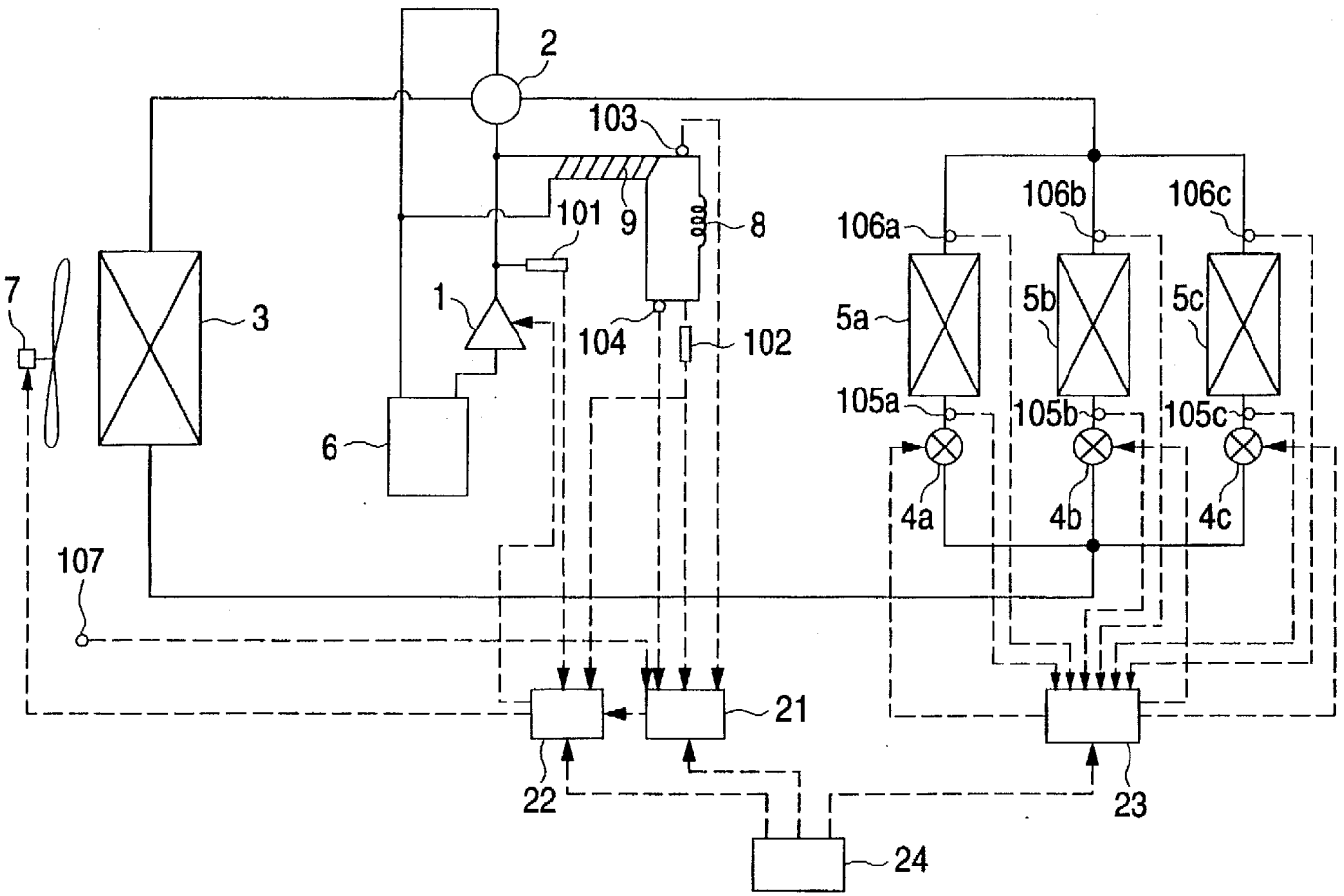
FIG. 9 is a refrigerant circuit diagram of a refrigerating and air-conditioning system according to a forth embodiment of this invention.
Figure 10:
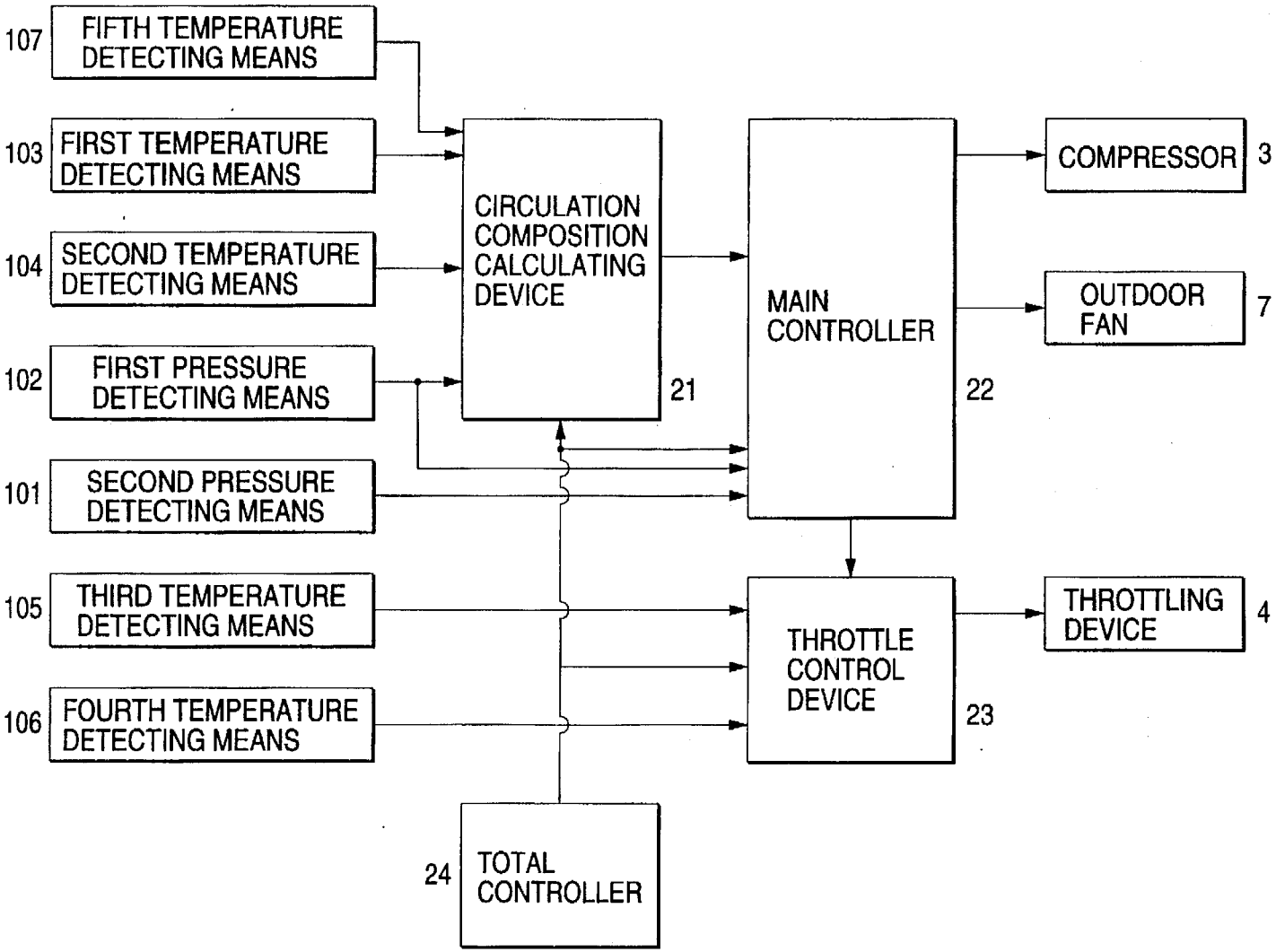
FIG. 10 is a block diagram showing a control operation of the system of the forth embodiment.
Figure 11:
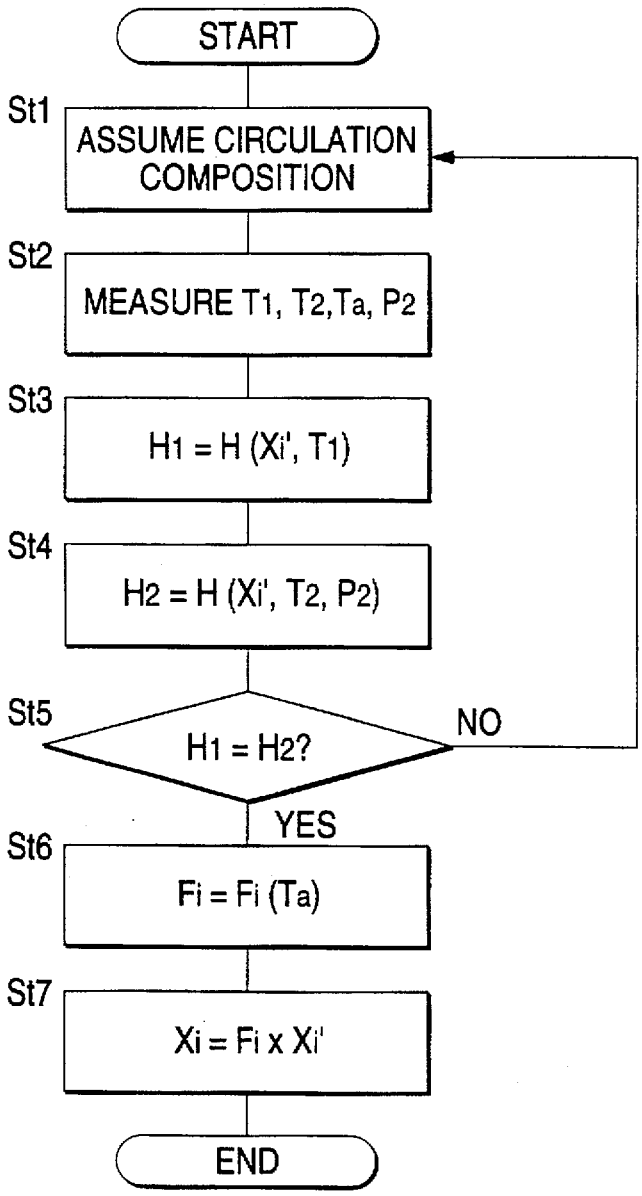
FIG. 11 is a flow chart showing a flow of composition calculation made by the system of the forth embodiment.

FIG. 9 is a view showing a refrigerating and air-conditioning system of the forth embodiment of this invention, and FIG. 10 shows in detail only its control parts. In the Figures, to the same elements as those in the first embodiment, the same reference numerals are affixed, and their explanation is omitted. In this embodiment, fifth temperature detecting means 107 is utilized to detect outdoor air temperature, in a similar refrigerant circuit to that of the first embodiment in FIG. 1.

In case where a composition detecting device is contained within the outside machine, it is susceptible to the variation of outdoor air temperature. Therefore, in this embodiment, the fifth temperature detecting means 107 is additionally provided to compensate for such variation of outdoor air temperature. The fifth temperature detecting means 107 may be any suitable means for detecting temperature of the air surrounding the composition detecting device mounted on the outdoor machine.

Next, the function of a composition calculating device 21 will be explained. FIG. 11 is a flow chart showing the flow of calculation made by the composition calculating device 21. As a first step of the calculation, in st1, for each of the components of mixture refrigerant, its composition $x_i'$ is assumed. In st2, values $T_1$, $T_2$, $T_a$ and $P_2$ are detected by first temperature detecting means 103, second temperature detecting means 104, fifth temperature detecting means 107 and first pressure detecting means 102, respectively. In st3, high-pressure liquid enthalpy $H_1$ is calculated on the basis of the circulation composition $x_i'$ assumed in st1 and the detected temperature value $T_1$. In st4, low-pressure two-phase enthalpy $H_2$ is calculated on the basis of the circulation composition $x_i'$ assumed in st1 and the detected temperature and pressure values $T_2$ and $P_2$. In st5, $H_1$ is compared with $H_2$, and this comparison is repeated for different assumptions of the circulation composition until $H_1$ becomes equal to $H_2$. The value of $x_i'$ at the time of when $H_1$ became equal to $H_2$ provides defined circulation composition. In st6, a compensating value $F_i$ for the circulation composition is found on the basis of the value $T_a$ detected by the fifth temperature detecting means. In st7, the true composition $x_i$ is calculated from the expression, $x_i=F_i \times x_i'$.

Figure 12:
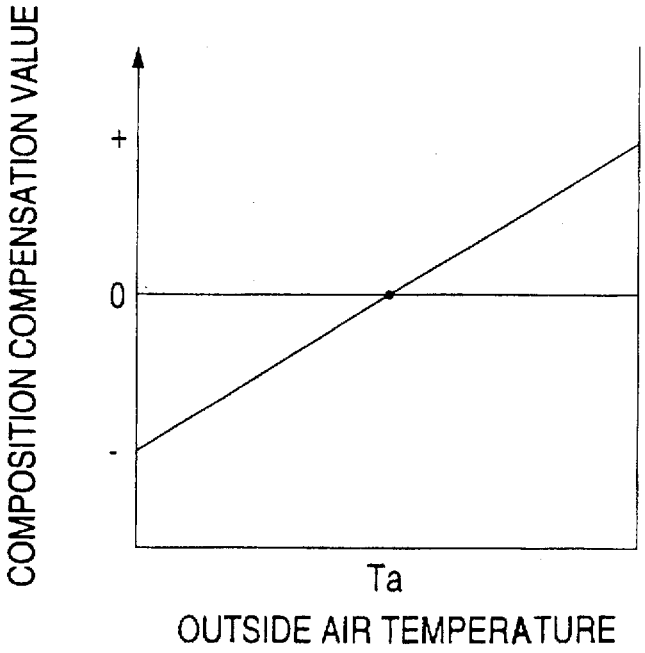
FIG. 12 is a composition compensation view showing the relationship between the outside air temperature and composition compensated values for explaining this invention.

However, equi-enthalpy change of refrigerant can not be assumed at the second throttling device 8 and before and behind it, since the refrigerant absorbs and radiates heat depending upon the temperature of the air which is in the vicinity of the second throttling device. Therefore, the compensating values $F_i$ may be pre-found experimentally as shown in FIG. 12.

Also, suffix i means mixture refrigerant in which i kinds of components are mixed.

In accordance with the above function, even though the outside air changed, there is heat absorption or radiation at the positions of the second throttling device 8 and its vicinities, and refrigerant does not carry out the equi-enthalpy change, it is possible to find out the circulation composition with precision.

That is to say, this constitution is for compensating for the amount of heat exchange in the throttle portion on the basis of the outdoor air temperature. This compensation may be carried out at any stage, for example at the time of the sensing, the composition calculating or the operation of the actuator.

In such an apparatus that the composition is detected and compensated for, any loss of the pipes in the respective portions may be compensated for to improve accuracy. For example, in carrying out the throttle control, the detection of indoor temperature may be compensated for in the same manner.

The above explanation related to an idea in which the composition detecting circuit is covered by the heat insulator to protect it from the change of the ambient temperature as has been explained in connection with the third embodiment, and an idea in which any change of the ambient temperature is detected to compensate for the sensed data as has been explained in connection with the forth embodiment, in case where the composition detecting circuit is positioned at a place in which temperature change is large, for example in case where low temperature condition is −15 degrees Celsius or overload condition is 43 degrees Celsius.

However, even though the composition detecting circuit is located at a place where it is hard to receive the effects of wind or a place where it is not affected by rainwater or drain water from the heat-exchanger, a considerable result can be obtained. For example, it is better to locate the composition detector so that it has a distance from the air course of the fun or a heat radiator such as the compressor, and further it is not just under the heat-exchanger, but is separated by a considerable distance therefrom. For example, with the composition detector disposed in or under a drain pan provided under the heat-exchanger, or contained within an electric panel box, a detection error can be suppressed to some extent.

Figure 23:
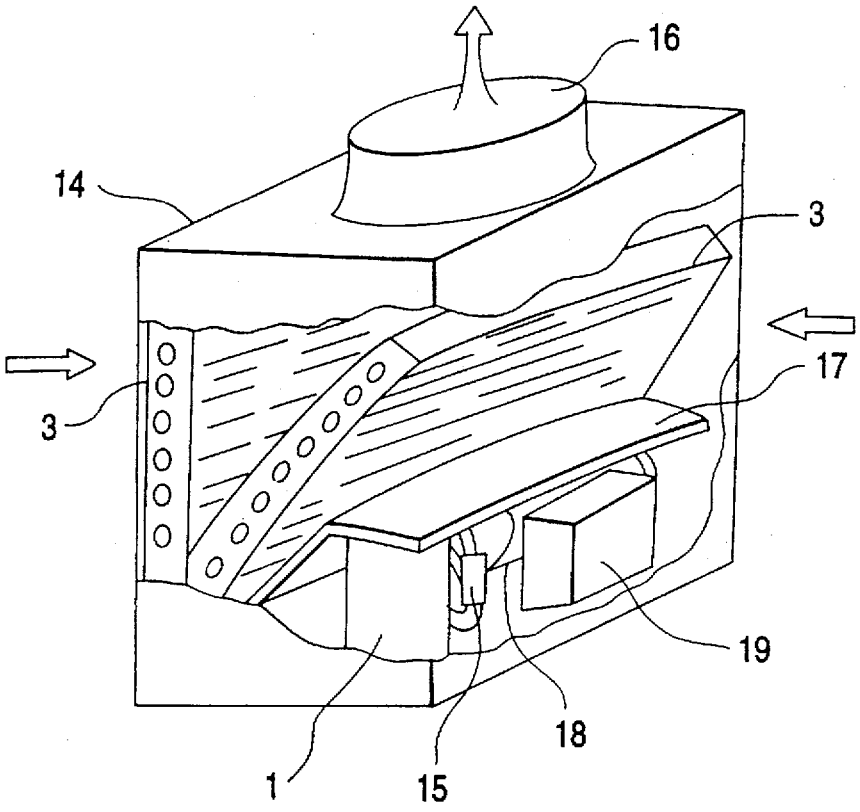
FIG. 23 is an explanatory view showing an outdoor machine of which one portion is cut out, as used in this invention.

Such example is shown in FIG. 23 in which a portion of the outdoor machine 14 is cut out to show the internal. Reference numeral 15 identifies a bypass circuit, 16 a blast port connected to a blower, 3 a heat-exchanger having a V-shaped structure, which sucks wind from its both sides in the direction indicated by the arrows and sends air through the upper blast port to the outside, to carry out heat exchanging, and 17 a cover for a mechanical room within which a compressor 1, an accumulator 18 and an electric panel box 19 are contained. The cover 17 is sealed to prevent the internal from the entrance of rainwater from the outside or drain water from the heat-exchanger.

Further, the composition calculating device assembled on a circuit board or the like is contained within the electric panel box for the sake of protection.

Embodiment 5

Hereinafter, a fifth embodiment of this invention will be explained referring to Figures.

In this embodiment, the constitutions and functions of a total controller 24, a main controller 22 and a composition calculating device 21 are the same as those in the first embodiment, and their explanation is omitted.

Figure 13:
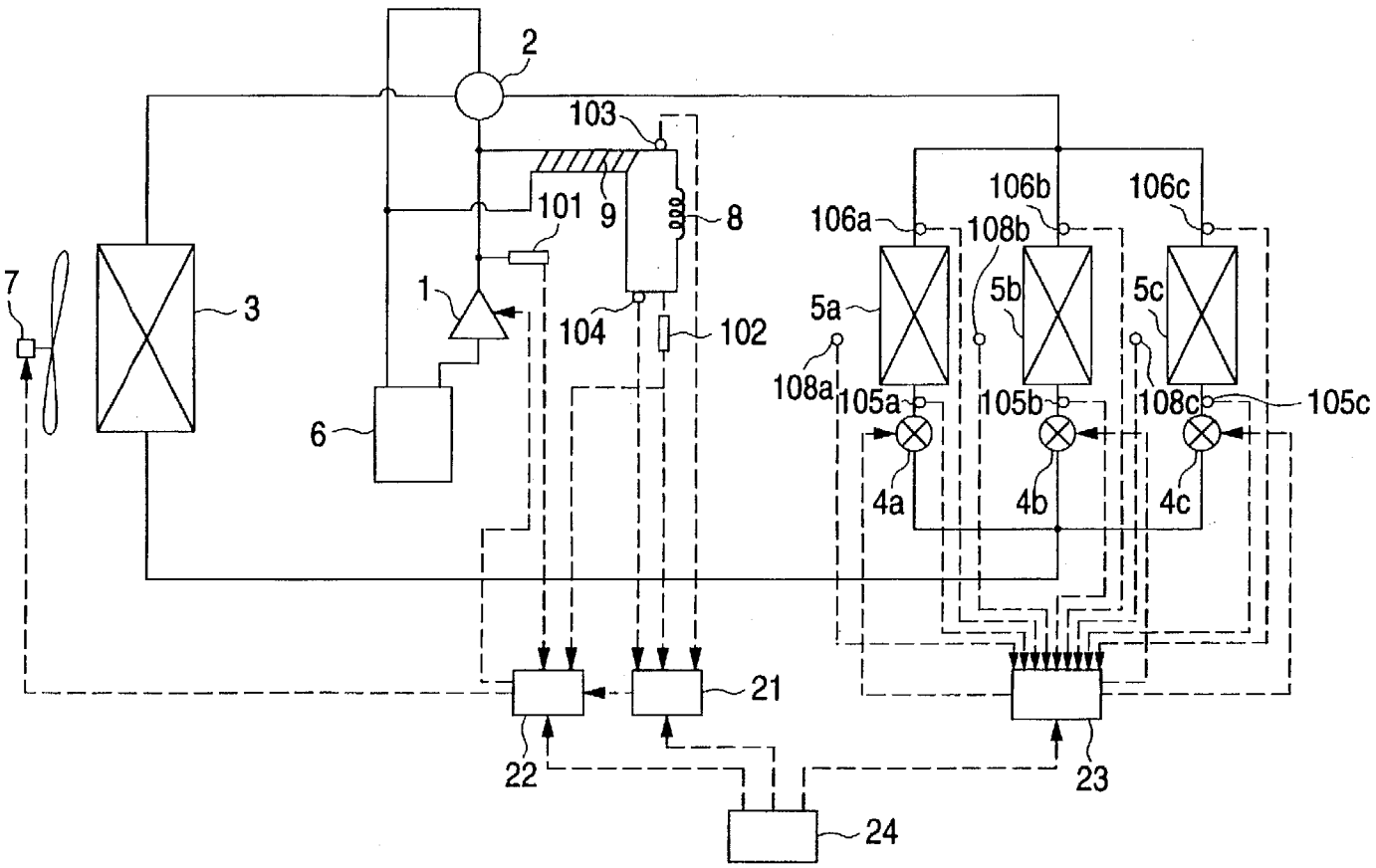
FIG. 13 is a refrigerant circuit diagram of a refrigerating and air-conditioning system according to a fifth embodiment of this invention.

FIG. 13 shows a refrigerating and air-conditioning system according to the fifth embodiment of this invention. In the Figure, to the same elements as those in the first embodiment, the same reference numerals are affixed, and their explanation is omitted. In this embodiment, sixth temperature detecting means 108 is addictively utilized to detect indoor air temperature, in a similar refrigerant circuit to that of the first embodiment in FIG. 1.

Figure 14:
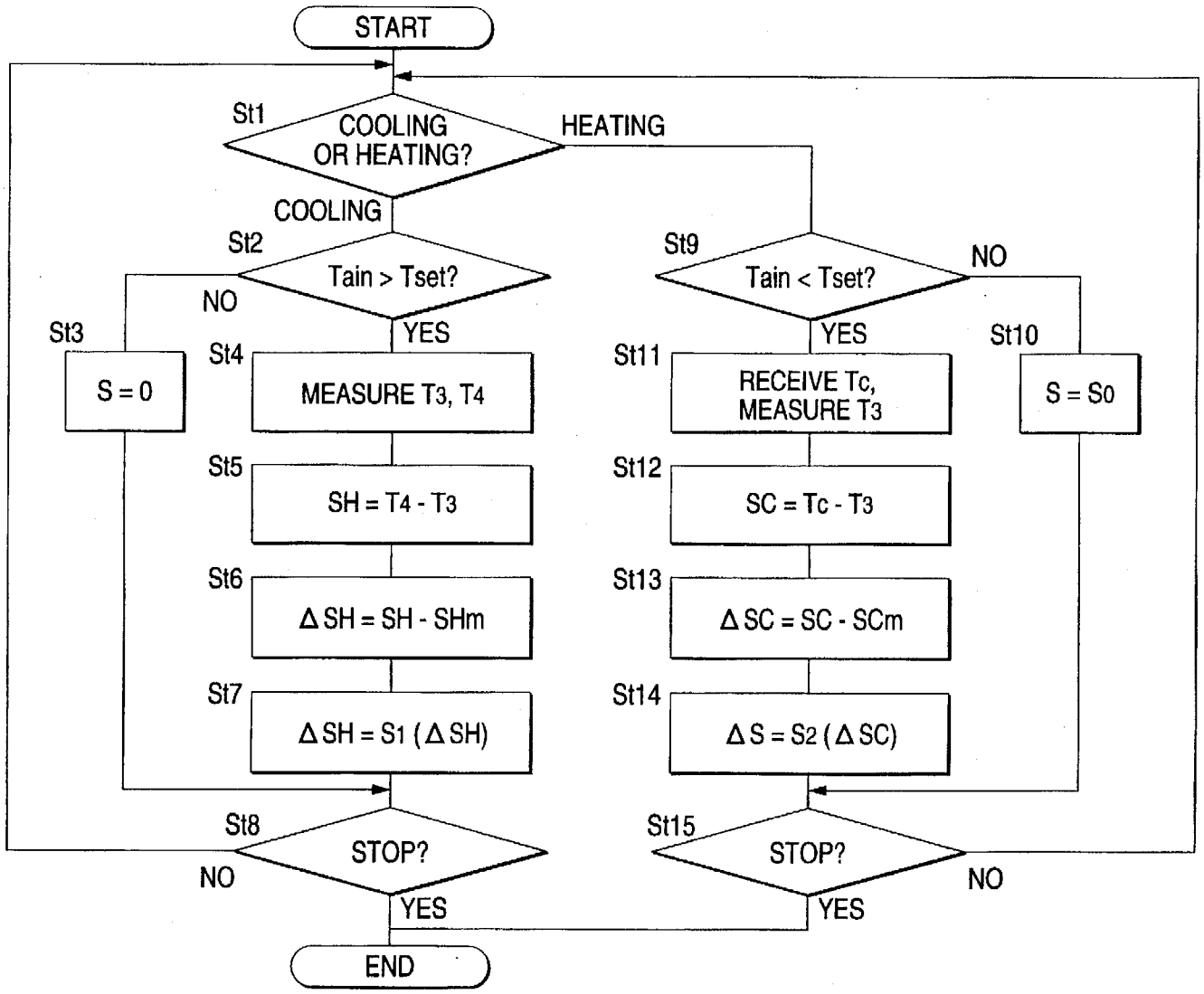
FIG. 14 is a flow chart showing a flow of control made by a throttle controller in the fifth embodiment.

The function of a throttle controller 23 is explained as follows. FIG. 14 is a flow chart showing the control of the throttle controller 23. In st1, a judgment is made as to whether the operation is in the cooling mode or the heating mode. In the case of the cooling mode, a value Tain detected by the sixth temperature detecting means 108 and a value Tset of temperature set are compared in amount in st2. If Tain<Tset, the value S of the opening of a first throttling device 4 is set to 0 in st3. However, if Tain>Tset, temperatures $T_3$ and $T_4$ are detected by a third temperature detecting means 105 and forth temperature detecting means 106, respectively in st4. In st5, difference SH between $T_3$ and $T_4$ is calculated. In st6, difference ΔSH between a predetermined target value SHm and the value SH is calculated. In st7, the change width ΔS of the opening of the first throttling device 4 is calculated on the basis of the amount of the value ΔSH, and the opening change of the first throttling device 4 is executed. In st8, if stop conditions are satisfied, the room machines are stooped, but they are unsatisfied, the process is returned to st1.

In the case of the heating operation mode, in st9, a value Tain detected by the sixth temperature detecting means 108 and a value Tset of temperature set are compared in amount. If Tain>Tset, the value S of the opening of the first throttling device 4 is set to a predetermined opening value $S_0$ in st10. However, if Tain<Tset, in st 11, temperatures $T_3$ is detected by the third temperature detecting means 105 and a value $T_c$ of condensation temperature is received from a main controller 22. In st12, difference SC between $T_3$ and $T_c$ is calculated. In st13, difference ΔSC between a predetermined target value SCm and the value SC is calculated. In st14, the change width ΔSH of the opening of the first throttling device 4 is calculated on the basis of the amount of the value ΔSC, and the opening change of the first throttling device 4 is executed. In st15, if stop conditions are satisfied, the room machines are stooped, but they are unsatisfied, the process is returned to st1.

Figure 15:
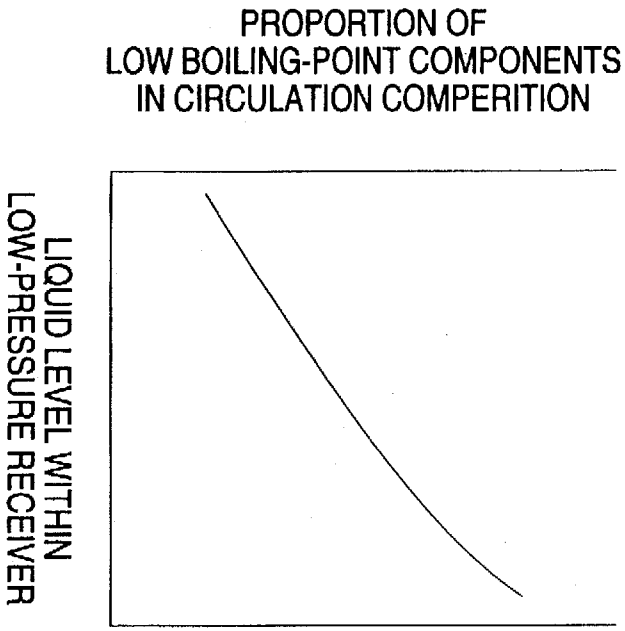
FIG. 15 is a relational view showing the relationship between the liquid level within a low-pressure receiver as used in this invention and low boiling-point components in circulation composition.

FIG. 15 shows the relationship between a liquid level within a low-pressure receiver 6 and the proportion of low boiling point components in circulation composition. As is clear from FIG. 15, as the liquid level within the low-pressure receiver 6 increases, the proportion of low boiling point components in circulation composition increases. Therefor, as described above, at the time of the heating operation, by opening moderately a first throttling device 4 in an indoor heat-exchanger 5 which is stopped, it is possible to prevent the puddle of refrigerant in the indoor heat-exchanger, and by maintain the liquid level of refrigerant within the low-pressure receiver 6, it is possible to suppress the variation of circulation composition and improve the controllability of the refrigerating cycle. Further, by monitoring the liquid level within the low-pressure receiver by a plurality of temperature sensors attached to the inner wall of the low-pressure receiver so that they are arranged in the vertical direction and by controlling the opening of the throttling device of the indoor machine which is stopped, when the monitored liquid level exceeds a range, it is possible to suppress large variation of the circulation composition.

Embodiment 6

Hereinafter, a sixth embodiment of this invention will be explained referring to Figures.

In this embodiment, the constitutions and functions of a total controller 24, a main controller 22 and a composition calculating device 21 are the same as those in the first embodiment, and their explanation is omitted.

Further, since a refrigerant circuit in this embodiment is the same as that in the fifth embodiment, its explanation is omitted.

Figure 16:
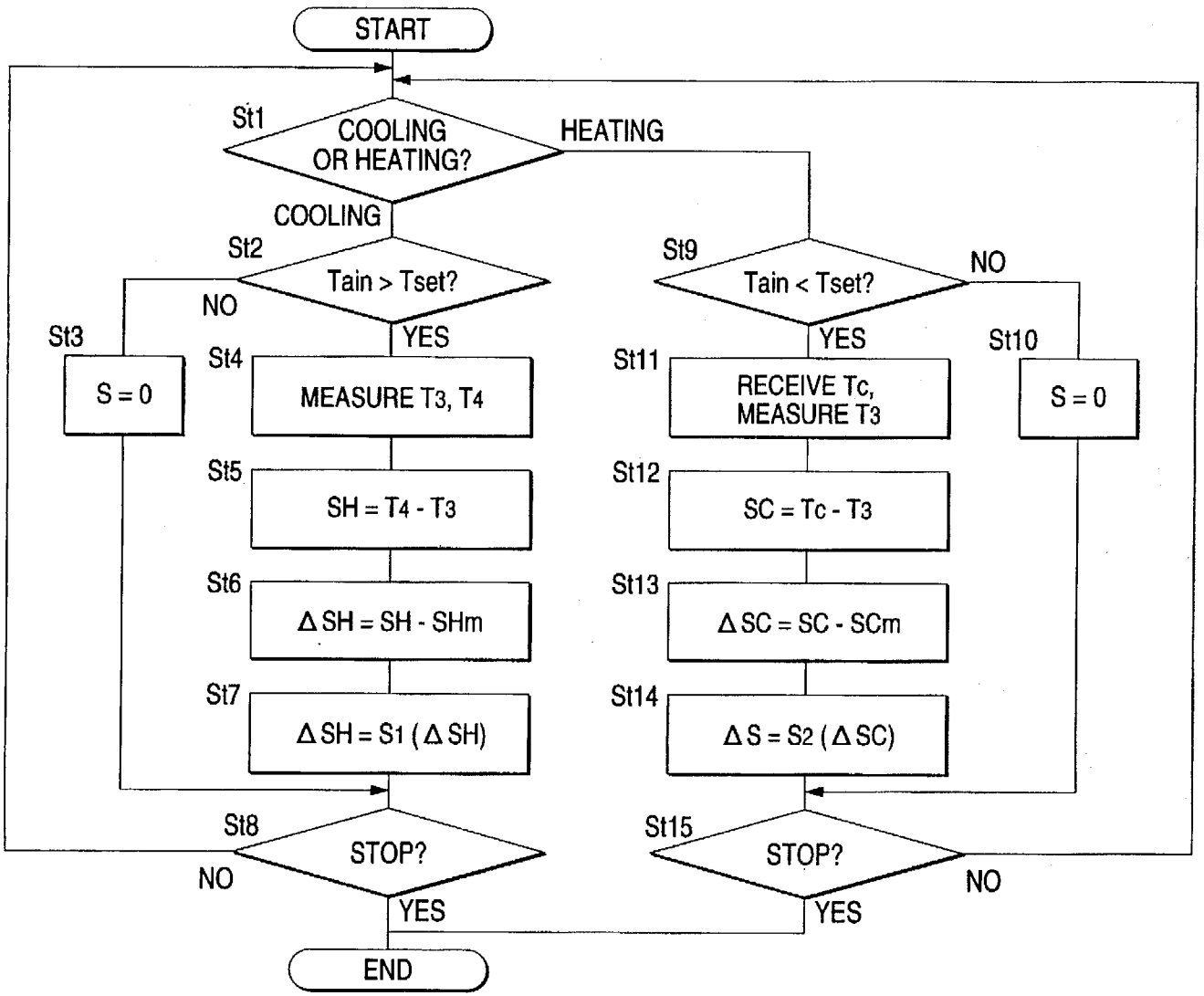
FIG. 16 is a refrigerant circuit diagram of a refrigerating and air-conditioning system according to a sixth embodiment of this invention.

The function of a throttle controller 23 is as follows. FIG. 16 is a flow chart showing the control of the throttle controller 23. In st1, a judgment is made as to whether the operation is in the cooling mode or the heating mode. In the case of the cooling mode, a value Tain detected by the sixth temperature detecting means 108 and a value Tset of temperature set are compared with each other in amount in st2. If Tain<Tset, the value S of the opening of a first throttling device 4 is set to 0 in st3. However, if Tain>Tset, temperatures $T_3$ and $T_4$ are detected by a third temperature detecting means 105 and forth temperature detecting means 106, respectively in st4. In st5, difference SH between $T_3$ and $T_4$ is calculated. In st6, difference ΔSH between a predetermined target value SHm and the value SH is calculated. In st7, the change width ΔS of the opening of the first throttling device 4 is calculated on the basis of the amount of the value ΔSH, and the opening change of the first throttling device 4 is executed. In st8, if stop conditions are satisfied, the room machines are stooped, but they are unsatisfied, the process is returned to st1.

In the case of the heating operation mode, in st9, a value Tain detected by the sixth temperature detecting means 108 and a value Tset of temperature set are compared in amount. If Tain>Tset, the value S of the opening of the first throttling device 4 is set to 0 in st10. However, if Tain<Tset, in st 11, temperatures $T_3$ is detected by the third temperature detecting means 105 and a value $T_c$ of condensation temperature is received from a main controller 22. In st12, difference SC between $T_3$ and $T_c$ is calculated. In st13, difference ΔSC between a predetermined target value SCm and the value SC is calculated. In st14, the change width ΔSH of the opening of the first throttling device 4 is calculated on the basis of the amount of the value ΔSC, and the opening change of the first throttling device 4 is executed. In st15, if stop conditions are satisfied, the room machines are stooped, but they are unsatisfied, the process is returned to st1.

In accordance with the above function, refrigerant to be circulated though an indoor machine which is in operation does not take a detour through an indoor machine which is not in operation. Therefore, since the entire refrigerant circulating through the main refrigerant circuit is passed through the indoor machine which is in operation and heat-exchanged by it, it is possible to prevent any loss of ability. Incidentally, while it is possible to withdraw refrigerant from the indoor machine which is not in operation, as explained above, in the all operation modes, it is most effective in the heating mode in controlling the composition (in the cooling mode, there is small surplus refrigerant by nature).

Embodiment 7

Hereinafter, a seventh embodiment of this invention will be explained referring to Figures.

In this embodiment, the constitutions and functions of a refrigerant circuit, a main controller 22, a composition calculating device 21 and a throttle controller 23 are the same as those in the sixth embodiment, and their explanation is omitted.

Further, since a refrigerant circuit in this embodiment is the same as that in the fifth embodiment, its explanation is omitted.

Figure 17:
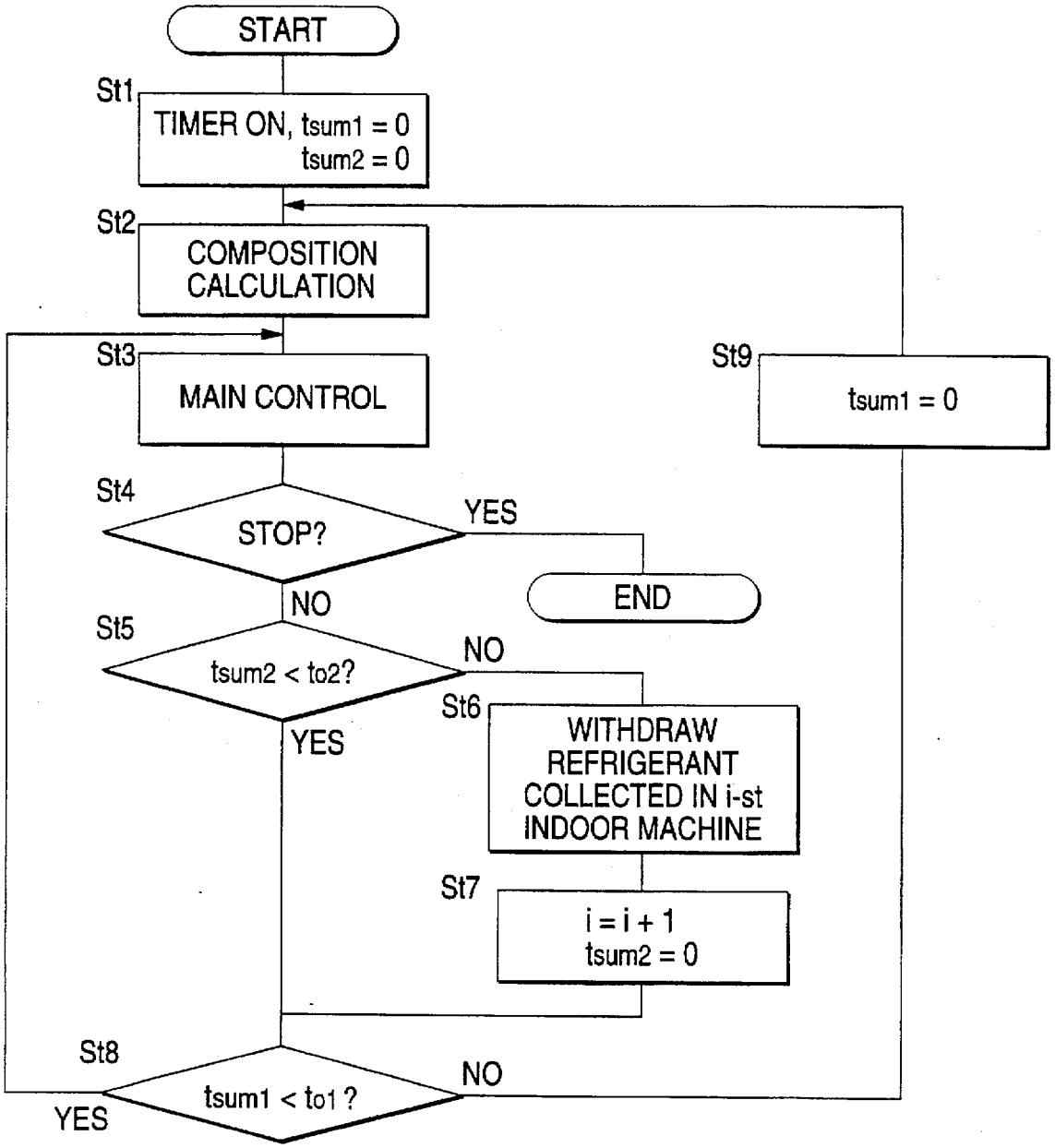
FIG. 17 is a flow chart showing a flow of control made by a total controller in a seventh embodiment of this invention.

FIG. 17 is a flow chart showing the function of a total controller 24. In st1, timers are started and integrated times are set so that $t_{sum}1=0$ and $t_{sum}2=0$. In st2, a command is given to the composition calculating device 21 so that circulation composition is calculated. After this calculation was made in the composition calculating device 21, control is shifted to st3 in which a command is issued for the main controller 22 to control the speed of rotation of the compressor 1 and the speed of rotation of the outdoor fun 7. In st4, the units are stopped when unit stop conditions are satisfied. However, if they are not satisfied, control is shifted to st5 in which the integrated time $t_{sum}2$ is compared to a predetermined composition calculation timing $t_o2$. If $t_{sum}2<t_o2$, the process shifts to st8. If $t_{sum}2>t_o2$ and $t_{sum}2=t_o2$, the process is sifted to st6, in which liquid refrigerant collected in an i-st indoor machine which is not in operation is withdrawn therefrom to a low-pressure receiver 6 by opening a corresponding first throttling device 4. In st7, a number for a indoor machine from which refrigerant will be withdrawn at next time is set as i=I+1, and after a reset is made so that $t_{sum}2=0$, the process is shifted to st8. If the number of i exceeds the number of the indoor machines which is now stopped, i=1 is set. In st8, the integrated time $t_{sum}1$ is compared with a predetermined composition calculating timing $t_o1$. If $t_{sum}1<t_o1$, the process returns to st3 without the composition calculation, and if $t_{sum}1>t_o1$ or $t_{sum}1=t_o1$, a reset is made so that $t_{sum}1=0$, and the process returns to st2.

Figure 18:
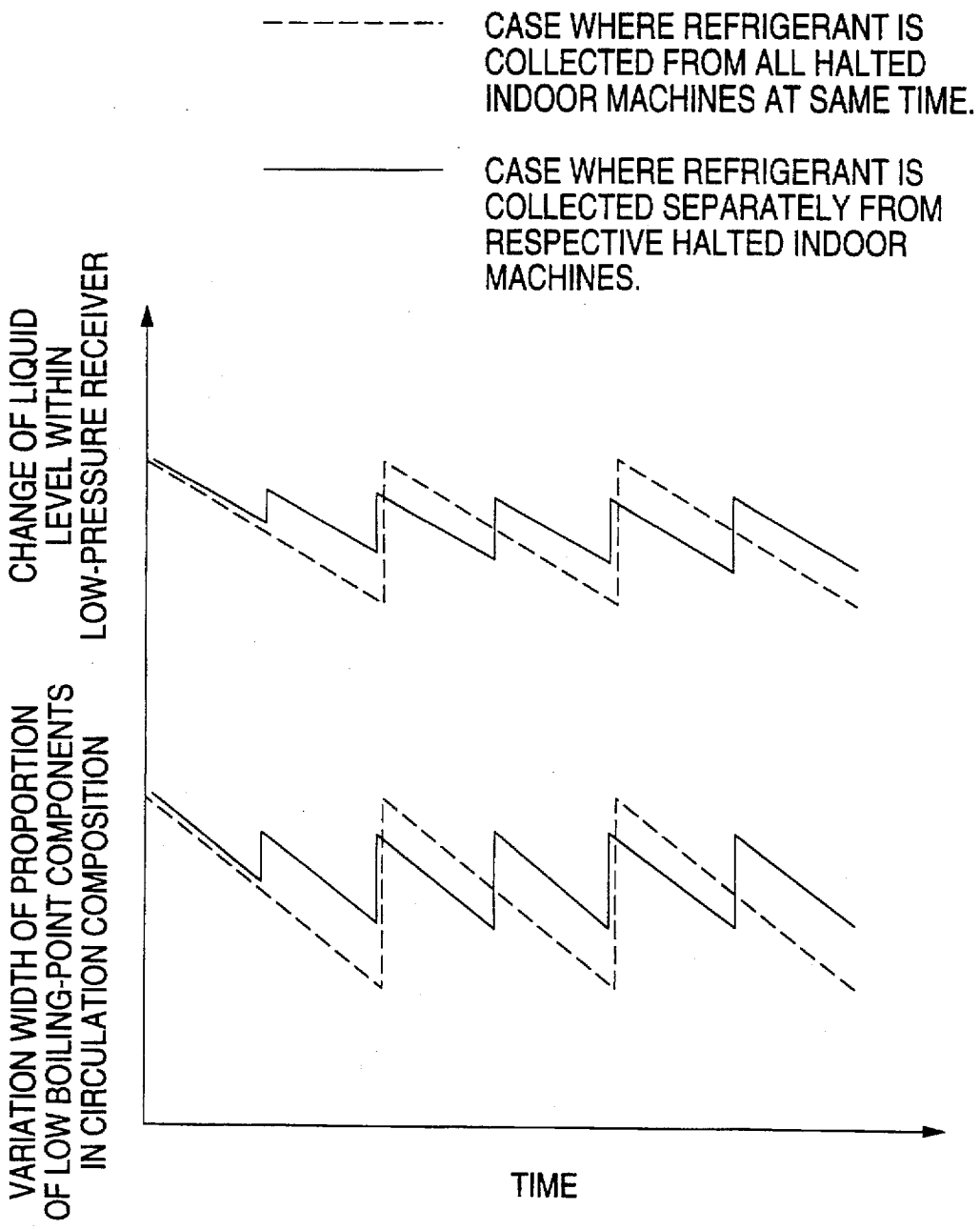
FIG. 18 is a relational view showing time change of the liquid level within a low-pressure receiver as used in this invention and circulation composition.

FIG. 18 shows a change of liquid level within the low-pressure receiver 6 and variation of circulation composition when the above-mentioned operations are executed. It is better to collect refrigerant separately from the respective halted indoor machines at different timings in accordance with the above-mentioned operations, rather than to collect refrigerant from all the halted indoor machines at the same time, because in the former the variation width of the liquid level within the low-pressure receiver 6 is smaller. As is clear from FIG. 15, since with the increase of the liquid level within the low-pressure receiver 6 the proportion of low boiling point components in circulation composition rises, it is possible to make the variation width of the circulation composition smaller if the variation width of the liquid level within the low-pressure receiver 6 is made smaller correspondingly. Therefore, this embodiment enables the operation of the system with suppressed variation of the characteristics of the refrigerating cycle and with good controllability and efficient conditions of composition.

As mentioned above, in case where a plurality of indoor machines are equipped with a refrigerating and air-conditioning system (multi-type), refrigerant is collected in the heat-exchanger, etc. of an indoor machine which is not in operation during the operation of the system, and the resultant puddle of refrigerant makes the variation width of the composition large. In such system, with the enlargement of the scale of the system, the number of the indoor machines usually increases. In such a large scale system, the withdrawal of refrigerant collected in halted indoor machines becomes a problem, and it becomes important to do this withdrawal while a variation in the characteristics of the system now operating is suppressed.

Embodiment 8

Hereinafter, a eighth embodiment of this invention will be explained referring to Figures.

In this embodiment, the constitutions and functions of a total controller 24, a main controller 22, a composition calculating device 21 and a throttle controller 23 are the same as those in the first embodiment, and their explanation is omitted.

Figure 19:
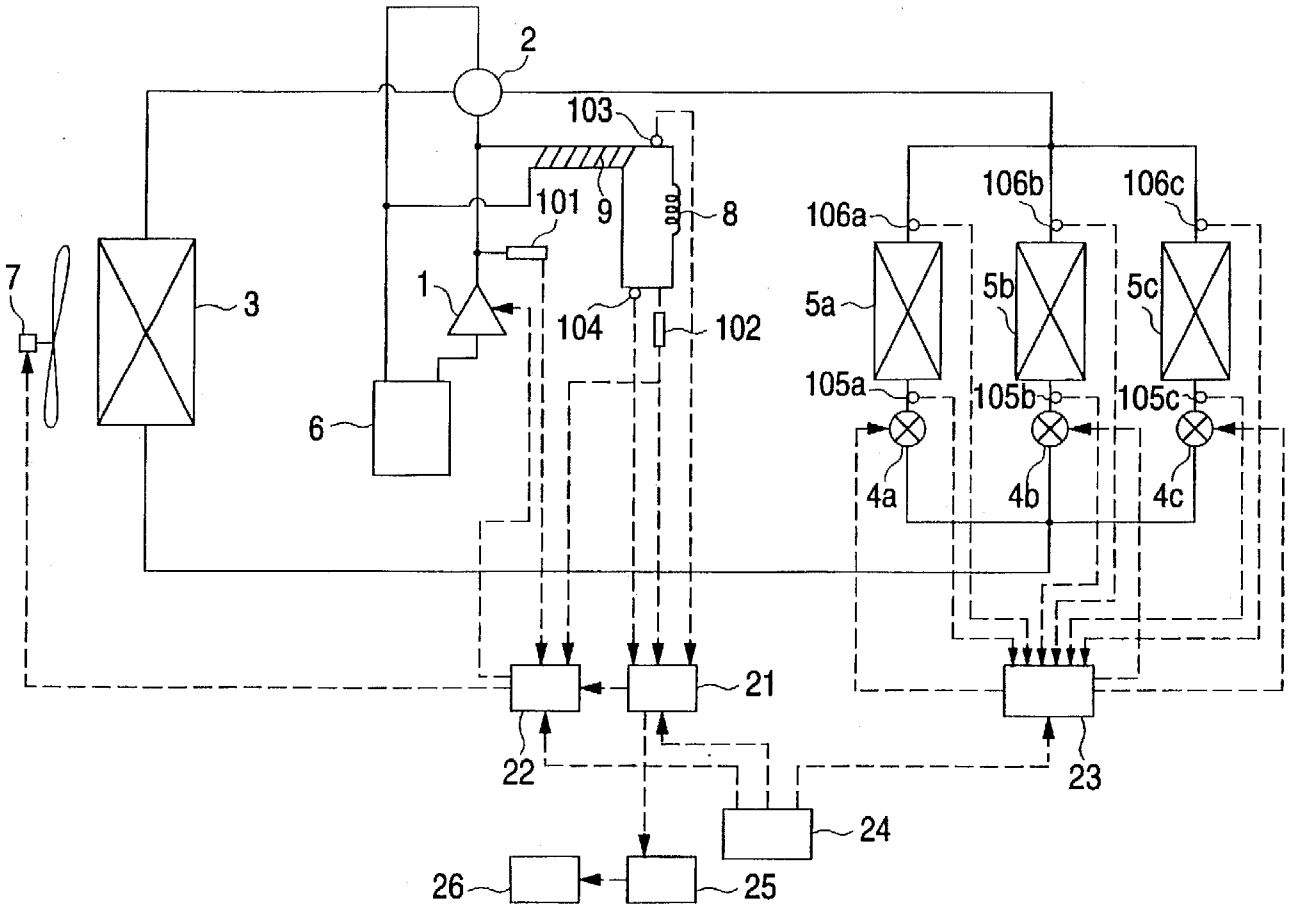
FIG. 19 is a refrigerant circuit diagram of a refrigerating and air-conditioning system according to a eighth embodiment of this invention.
Figure 20:
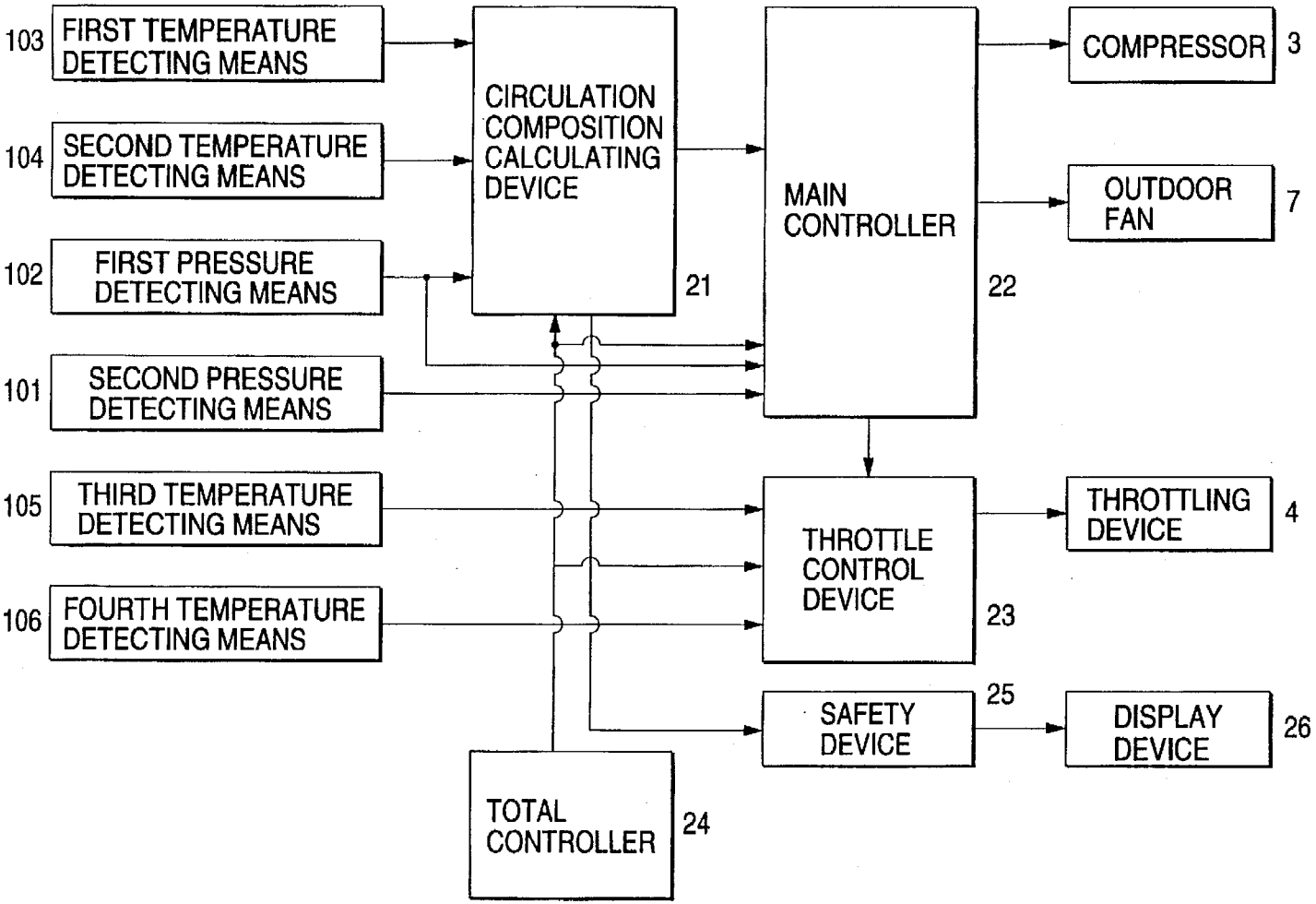
FIG. 20 is a block diagram showing a control operation of the system of the forth embodiment.

FIG. 19 shows a refrigerating and sir-conditioning system according to the eighth embodiment of this invention, and FIG. 20 shows in detail only its control part. In the Figure, to the same elements as those in the first embodiment, the same reference numerals are affixed, and their explanation is omitted. In this embodiment, a safety device 25 for stopping a unit when calculated circulation composition provided by composition calculating means 21 is not within the range of the values of predetermined circulation composition, and a display device 26 for displaying the refrigerant composition at that time are addictively provided in a refrigerant circuit similar to that in FIG. 1 showing the first embodiment of this invention.

Accordingly, it is possible to stop the unit whenever the composition of filled refrigerant during a refrigerating cycle becomes abnormal because of mis-filling of refrigerant, leakage of refrigerant, etc. Also, the display of the state of the composition provides convenience to the operator of the system.

Embodiment 9

Hereinafter, a ninth embodiment of this invention will be explained referring to Figures.

In this embodiment, the constitutions and functions of a total controller 24, a main controller 22 and a throttle controller 23 are the same as those in the first embodiment, and their explanation is omitted.

Figure 24:
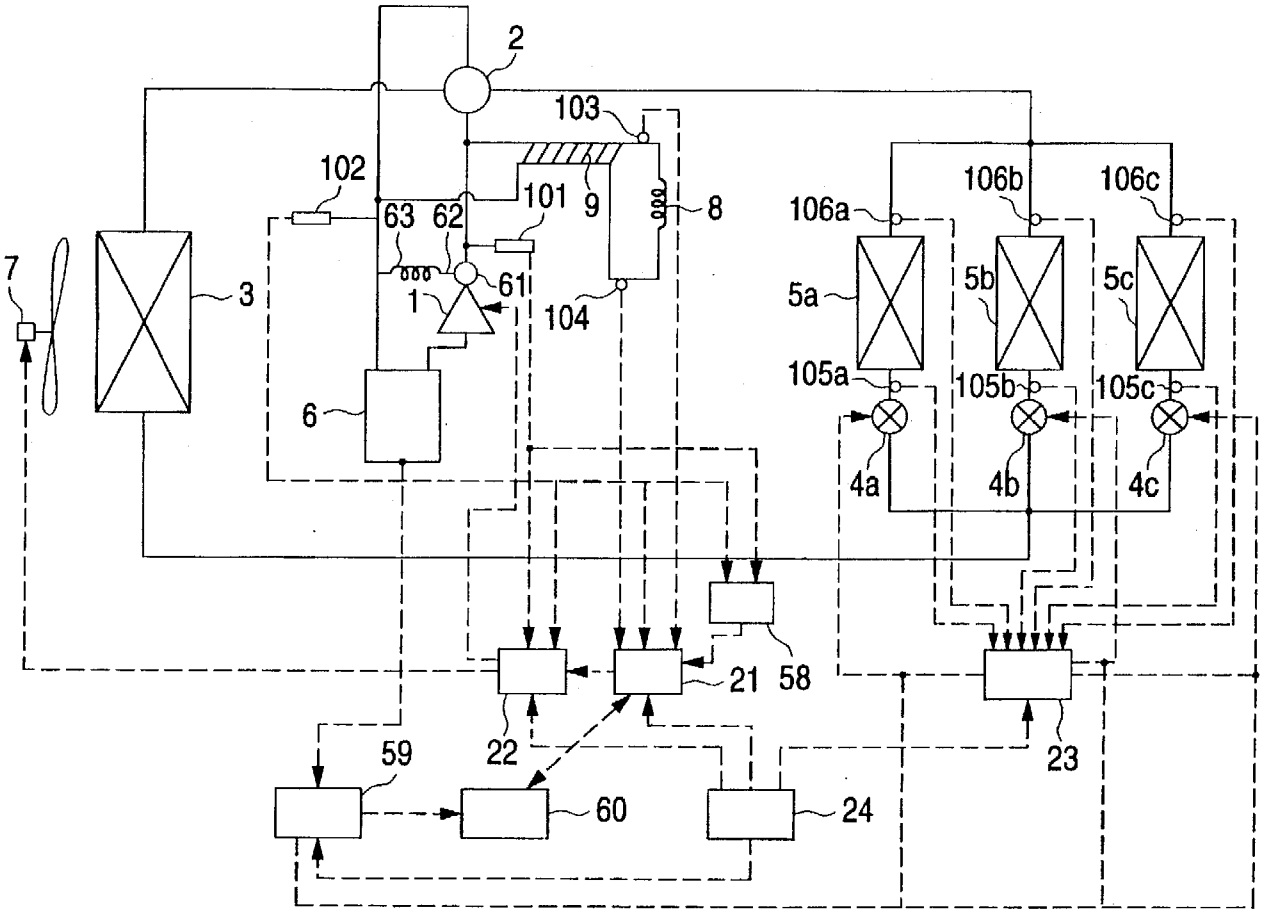
FIG. 24 is a refrigerant circuit diagram of a refrigerating and air-conditioning system according to a ninth embodiment of this invention.

FIG. 24 shows a refrigerating and air-conditioning system according to the ninth embodiment of this invention. In the Figure, to the same elements as those in the first embodiment, the same reference numerals are affixed, and their explanation is omitted. In FIG. 24, reference numeral 61 identifies an oil separator, 62 an oil feedback and bypass pipe, and 63 a third throttling device. The oil separator 61 is located between a compressor 1 and a four-way valve 2, and the oil feedback and bypass pipe 62 is connected at its one end to the oil separator 61 and at its other end to one end of the third throttling device 63, of which other end is connected to a pipe between the four-way valve 2 and an accumulator 6. The oil separator 61 separates oil from refrigerant. The oil separated in the oil separator 61 is pressure-reduced by the third throttling device 63 and returned to the accumulator 6 through the oil bypass pipe 62.

The oil separator 61 provided in the discharging pipe of the compressor 1 separates gas refrigerant discharged from the compressor and refrigerating machine oil by a filter provided within a container, and returns the refrigerating machine oil directly to the compressor. Thus, the refrigerating machine oil flows through the main circuit and therefore reduction of the amount of oil in the compressor can be prevented.

Such oil separator is often used in a machine which has an elongated pipes, or in which evaporating temperature is low or a large quantity of oil is discharged from the compressor.

In the oil separator 61, refrigerant and oil are blown together into the container through the filter on the order of 100 mesh size to separate the oil from the refrigerant. The oil obtained from the bottom portion of the container is returned to the compressor and the gas refrigerant from the top portion of the container is returned to the main circuit.

In the embodiment, the high-pressure side inlet of the composition detecting heat-exchanger 9 is connected to a pipe between the oil separator 61 and the four-way valve 2. This is because the composition detecting heat-exchanger can be made small in shape, since between the oil separator 61 and the four-way valve 2 the degree of overheating of refrigerant becomes small, and at the inlet of the second throttling device 8 the degree of over cooling os refrigerant becomes large. Further, in this case, the quantity of oil flowing the bypass circuit 15 can be small, and as a result pressure pulsation is hard to occur.

In FIG. 24, reference numeral 102 identifies second pressure detecting means, which is connected to a junction between the low-pressure side of the composition detecting heat-exchanger 9 and the main pipe. If the second pressure detecting means 102 is connected in the vicinity of the outlet of the second throttling device 8, a large error in detection of circulation composition is produced because of the pressure pulsation at that place. Therefore, the second pressure detecting means 102 is attached to the main pipe to detect the pressure of the refrigerant flowing therethrough which never produces pressure pulsation. Reference numeral 108 indicates a liquid level detector for the accumulator, 58 a pressure difference calculator, 59 a composition regulating operation controller and 60 a composition detected value compensator.

Figure 25:
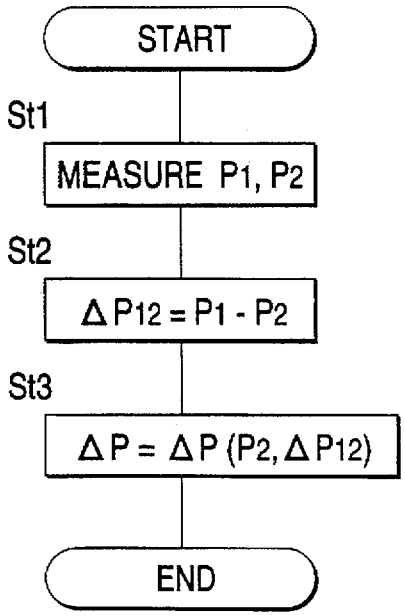
FIG. 25 is a flow chart showing a flow of calculation made by a pressure difference calculating device in the ninth embodiment of this invention.

Next, the operation of the pressure difference calculator 58 will be explained. FIG. 25 is a flow chart showing the control contents for the pressure difference calculator 58. In st1, values P1 and P2 are detected by the first pressure detecting means 101 and the second pressure detecting means 102, respectively. In st2, difference $\Delta P12$ between the detected pressure values P1 and P2 is calculated. In st3, pressure difference $\Delta P$ between the pressure at the second pressure detecting means and pressure at the downstream of the third throttling device is computed on the basis of P2 and $\Delta P12$.

Figure 26:
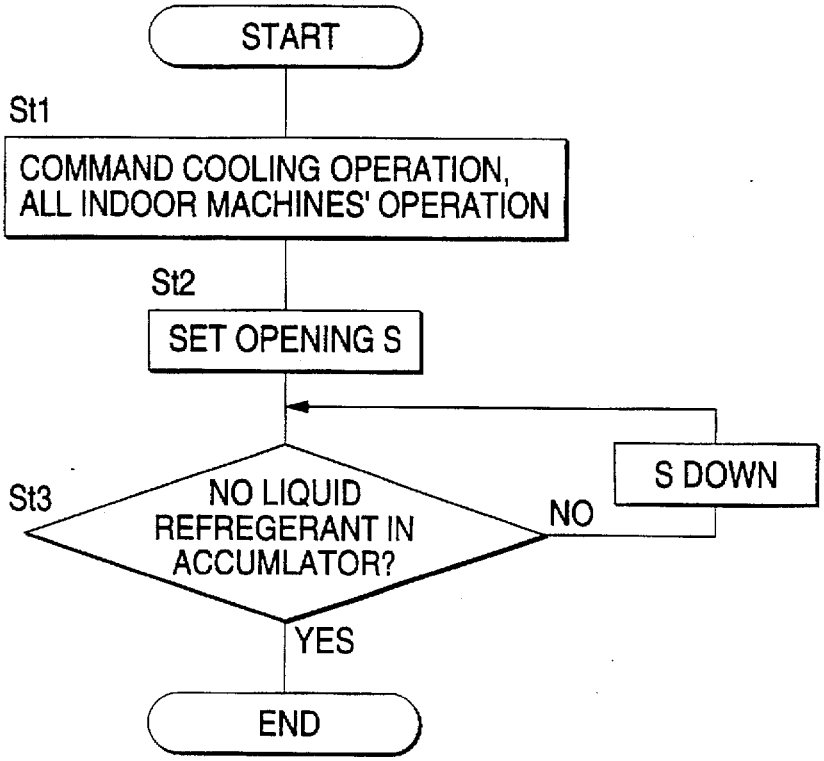
FIG. 26 is a flow chart showing a flow of control made by a composition regulating operation controller in the ninth embodiment of this invention.

Next, the operation of the composition regulating operation controller 59. It is used in trial run, for example. FIG. 26 is a flow chart showing the control contents for the composition regulating operation controller 59. In st1, a command is sent to the total controller to operate all of the indoor machines in the cooling mode. In st2, the opening S of the first throttling device is fixed at a moderate value. In st3, a signal from the liquid level detector 107 for the accumulator is detected. If there is excessive refrigerant in the accumulator, in st4, the opening S of a first expansion valve 4 is set to be small. This is repeated until there is no excessive refrigerant in the accumulator, whereupon an operation condition is set in which there is no indoor machine which is not in operation in the cooling mode, and there is no excessive refrigerant in the accumulator. In such operation condition, circulation composition agrees with fill composition. Incidentally, in the above example, the case where the operation mode is cooling, there is no halted indoor machine and there is no excessive refrigerant in the accumulator was shown as a composition regulating operation, but as long as the operation condition and the circulation composition at that time have been known, any operation condition may be utilized.

Figure 27:
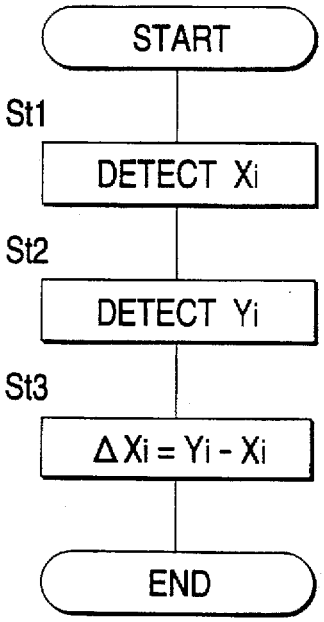
FIG. 27 is a flow chart showing a flow of calculation made by a composition compensated value calculating device in the ninth embodiment of this invention.

Next, the operation of the composition detected value compensator 60 will be explained. FIG. 27 is a flow chart showing the flow of calculations made by the composition detected value compensator 60. In st1, a circulation composition calculated value $x_1$ is detected by a composition calculating device 21. In st2, it is confirmed that the system is in the composition regulating operation, and circulation composition $Y_i$ in the composition regulating operation condition, which has been input previously, is detected. In st3, a composition compensating value $_x_i$ is found out from difference between the circulation composition $y_i$ and the circulation composition calculated value $x_1$.

Figure 28:
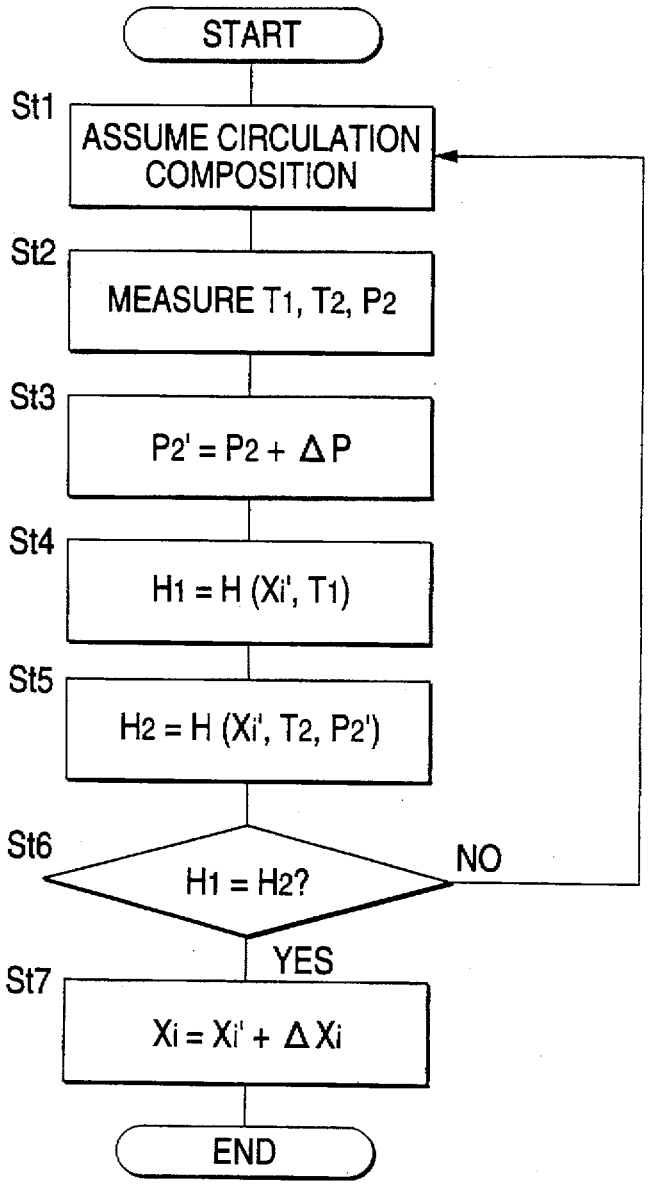
FIG. 28 is a flow chart showing a flow of composition calculation made by the system of the ninth embodiment of this invention.
Figure 29:
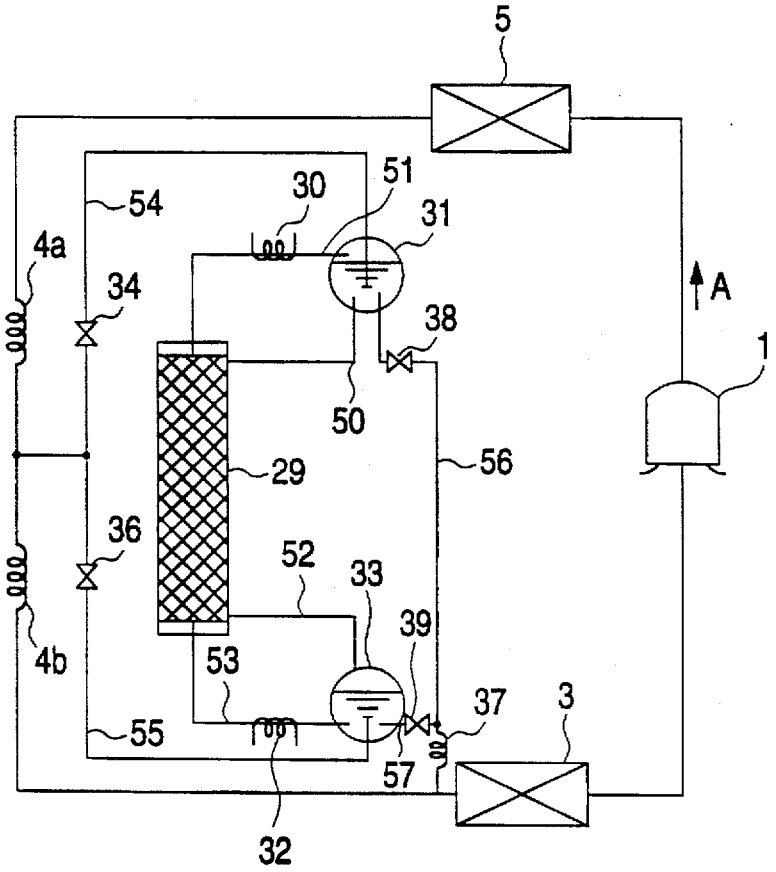
FIG. 29 PRIOR ART
FIG. 29 is a refrigerant circuit diagram of a prior art refrigerating and air-conditioning system.

Next, the operation of the composition calculating device 21. FIG. 28 is a flow chart showing flow of the composition calculation. As a first step of the calculation, in st1, for each of the components of mixture refrigerant, its composition $x_i'$ is assumed. In st2, values $T_1$, $T_2$, and $P_2$ are detected by first temperature detecting means 103, second temperature detecting means 104 and second pressure detecting means 102, respectively. In st3, pressure $P_2'$ of a third throttling device is calculated on the basis of $P_2$ and $\Delta P$ calculated in the pressure difference calculating device 58. In st4, high-pressure liquid enthalpy $H_1$ is calculated on the basis of the circulation composition $x_i'$ assumed in st1 and the detected temperature value T. In st5, low-pressure two-phase enthalpy $H_2$ is calculated on the basis of the circulation composition $x_i'$ assumed in st1, the detected temperature value $T_1$ and the pressure value $P_2'$ of the third throttling device. In st6, $H_1$ is compared with $H_2$, and this comparison is repeated for different assumptions of the circulation composition until $H_1$ becomes equal to $H_2$. The value of $x_i'$ at the time of when H became equal to $H_2$ provides defined circulation composition. In st7, the true composition $x_i$ is provided from addition of the defined circulation composition $x_i'$ and a composition compensating value $\Delta x_i$.

Also, suffix i means mixture refrigerant in which i kinds of components are mixed.

As has been explained, in accordance with this invention, since in a refrigerating system connected by a compressor, a four-way valve, an outdoor heat-exchanger, a throttling device, a plurality of indoor heat-exchanger and a low-pressure receiver, there are provided a composition calculating device for calculating circulation composition, a main controller for determining the number of rotation of the compressor and the number of rotation of an outdoor fun, a throttle controller for determining the opening of the throttling device and a total controller for determining the timing of the composition calculation, main control and throttle control, it is possible for a multi-type refrigerating and air-conditioning system to detect the circulation composition, calculate condensation temperature and evaporation temperature on the basis of the detected circulation composition and detected low-pressure and high-pressure values, respectively, and control the number of rotation of the compressor, the number of rotation of the outdoor fun and the opening of the throttling device to maintain the condensation temperature and evaporation temperature constant, and even when the circulation composition changed with operation conditions, efficient operation can be realized.

Further, in the refrigerating system, when the total controller judged that time change of a physical quantity detected during the refrigerating cycle is large, the calculating timing for the circulation composition is made small. This enables the detection of composition depending upon the change of composition in an unsteady state so that control is made with the circulation composition which is always correct. This contributes to good controllability.

Also, in a steady state, too, it is possible to reduce calculation load in the steady state control by making the time interval for the calculation of the circulation composition longer.

Also, in the refrigerating system, by heat-isolating the second throttling device and the refrigerant pipe portions before and behind it from the outside air to prohibit mutual delivery of heat therebetween, refrigerant has the sure behavior of equi-enthalpy change in the throttling portion. In the calculation of circulation composition, since the equi-enthalpy change of refrigerant at the position of the throttling portion is used, it is possible to improve accuracy in sensing the circulation composition if the equi-enthalpy change is carried out reliably.

Also, in the refrigerating system, by judging the amount of heat exchange between the outside and the throttling portion (the second throttling device and the refrigerant pipe portions before and behind it) from the outside air temperature by the composition calculator to provide some compensation to the calculated composition, the circulation composition can be obtained with high precision even though the outside air temperature was changed, and accuracy in detecting the composition can be improved without the addition of special price.

Also, in the refrigerating system, by setting properly the opening of a throttling device for a halted indoor machine to prevent refrigerant from being collected in the halted indoor machine and to maintain the liquid level within the low-pressure receiver, it is possible to operate the system with the efficient and controllable circulation composition, since the refrigerating system can be controlled by the composition which is caused to be always stabilized.

Also, in the refrigerating system, by entirely releasing the opening of the throttling device for the halted indoor machine, since refrigerant to be circulated through the indoor machines which are in operation does not circulate in the halted indoor machine, and the entire refrigerant flowing through the main circuit exchanges heat in the indoor machines which are in operation, it is possible to check a loss of the ability, and thereby to operate the system efficiently.

Also, in the refrigerating system, when liquid refrigerant residing in a plurality of halted indoor machines is returned to the main circuit, by collect it from the respective halted indoor machines individually at different timings, it is possible to restrain rapid change of the liquid level within the low-pressure receiver. Therefore, since the resulting rapid change of composition can be avoided, dependability of the refrigerating and air-conditioning system itself can be raised, and it is possible to operate the system with efficient circulation composition.

Also, in the refrigerating system, when the composition which was detected exceeds a predetermined range of composition, the units can be stopped, and the circulation composition which is composed at that time can be displayed. Therefore, it is possible to raise safety and improve serviceability.

What is claimed is:

1. A refrigerant circulating system comprising:

a main refrigerant circuit for circulating mixture refrigerant, said main refrigerant circuit including a compressor, a directional control valve, a condenser, a first throttling device and an evaporator;

a bypass circuit diverging from a point between a discharge portion of said compressor and said directional control valve, and connected through a composition detecting heat-exchanger and a second throttling device to a point between an intake portion of said compressor and said directional control valve;

first temperature detecting means located to a point between said composition detecting heat-exchanger and said second throttling device, said first temperature detecting means detecting refrigerant temperature at an upstream of said second throttling device;

second temperature detecting means located to a point between said composition detecting heat-exchanger and said second throttling device, said second temperature detecting means detecting refrigerant temperature at a downstream of said second throttling device;

first pressure detecting means located at an intake side of said compressor, and for detecting a pressure of refrigerant at its located place;

a composition calculating device for calculating a composition of mixture refrigerant on the basis of the detected refrigerant temperature and pressure;

second pressure detecting means located at the discharge side of said compressor, and for detecting the pressure of refrigerant at its located place; and a main controller for controlling at least compressor speed or fan speed provided to said condenser or evaporator, on the basis of the calculated composition of refrigerant and detected pressure of refrigerant.

2. A refrigerant circulating system as claimed in claim 1, wherein said main refrigerant circuit further includes a an accumulator, and the bypass circuit is connected to a point between the accumulator and the directional control valve;

the refrigerant circulating system further comprising a third throttling device for coupling a high-pressure side inlet of said composition detecting heat-exchanger and a low-pressure side outlet of said composition detecting heat-exchanger.

3. A refrigerant circulating system as claimed in claim 1, wherein said main refrigerant circuit includes an outdoor heat-exchanger and an indoor heat-exchanger, said compressor, said outdoor heat-exchanger and said bypass circuit being housed within an outdoor machine.

4. A refrigerant circulating system as claimed in claim 1, further comprising:

a throttle controller for controlling the opening of said first throttling device; and a total controller including a timer and for controlling the control timings of said composition calculating device, main controller and throttle controller.

5. A refrigerant circulating system as claimed in claim 4, wherein the control timing of said total controller is controlled on the basis of the time interval of the composition calculation of said composition calculating device.

6. A refrigerant circulating system as claimed in claim 4, wherein a first throttling device for a indoor machine which is not in operation is controlled to have a predetermined opening at the time of the heating operation.

7. A refrigerant circulating system as claimed in claim 4, wherein a first throttling device for a indoor machine which is not in operation is controlled to be closed at the time of the heating operation.

8. A refrigerant circulating system as claimed in claim 1, wherein said bypass circuit is diverged from a discharge portion of said compressor, and extended to a low-pressure portion;

said refrigerant circulating system further comprising:

is third temperature detecting means for detecting temperature in the main circuit between said first throttling device and said indoor heat-exchanger; and forth temperature detecting means for detecting temperature at the low-pressure portion.

9. A refrigerant circulating system as claimed in claim 1, wherein said composition calculating device detects a physical quantity representative of an operational state of refrigerant circulation, and changes time interval for the composition calculation when the time change of said detected value is above a predetermined value.

10. A refrigerant circulating system as claimed in claim 1, wherein said indoor heat-exchanger comprises a plurality of heat-exchangers adapted to be operated so that a part thereof is in operation and the other is not in operation.

11. A refrigerant circulating system as claimed in claim 10, wherein a respective first throttling device for a respective indoor machine which is not in operation is controlled so that it is opened at different timings, when refrigerant resident in the indoor machines which are not in operation is returned to the main circuit.

12. A refrigerant circulating system as claimed in claim 1, wherein said second throttling device and a pipe portion between said second throttling device and said composition detecting heat-exchanger are heat-isolated.

13. A refrigerant circulating system as claimed in claim 1, wherein the circulation composition obtained through the calculation of said composition calculating device is compensated for with respect to the outside air temperature.

14. A refrigerant circulating system as claimed in claims 1, wherein the refrigerant circulating system includes a safety device for examining whether the composition calculated by said composition calculating device is within a range of a predetermined composition and stooping the unit when the examination showed that the detected composition is not within a proper range, and/or a display device for displaying the composition when its abnormality was detected.

15. A refrigerant circulating system as claimed in claim 1, wherein said main refrigerant circuit further includes an oil separator, the a bypass circuit is diverged from a point between the oil separator and the directional control valve, and a third throttling device is provided to couple the high-pressure side inlet of the composition detecting heat-exchanger to the low-pressure side outlet of the composition detecting heat-exchanger.

16. A refrigerant circulating system as claimed in claim 1, wherein said second pressure detecting means is located on a pipe connecting the inlet portion of said compressor and said directional control valve which is located at the connection of the low-pressure side of said composition detecting heat-exchanger to the pipe connecting the inlet portion of said compressor and said directional control valve.

17. A refrigerant circulating system as claimed in claim 1, wherein said second temperature detecting means is located to be separated from said second throttling device by at least a distance corresponding to pipe length through which the flow of two-phase refrigerant develops.

18. A refrigerant circulating system as claimed in claim 1, wherein pressure loss at the low-pressure side of said composition detecting heat-exchanger is set such that pressure at a low-pressure pressure sensor is substantially coincident with pressure at the inlet portion of said compressor.

19. A refrigerant circulating system as claimed in claim 1, further comprising:

a low-pressure side pressure loss calculating device for said composition detecting heat-exchanger.

20. A refrigerant circulating system as claimed in claim 1, further comprising:

a composition regulating operation controller providing an operation state in which the circulation composition is pre-known; and a composition compensating value calculating device for calculating difference between the composition value calculated at that time and a pre-known circulation composition; and wherein the composition calculated in said composition calculating device is compensated for on the basis of the composition compensating value which has sought at the time of the composition regulating operation.

* * * * *

UNITED STATES PATENT AND TRADEMARK OFFICE

CERTIFICATE OF CORRECTION

PATENT NO. : 5,737,931
DATED : April 14, 1998
INVENTOR(S) : Ueno, et al

It is certified that error appears in the above-identified patent and that said Letters Patent is hereby corrected as shown below:

Column 25, line 53, delete "a".

Signed and Sealed this

Ninth Day of February, 1999

*Attest:*

*Acting Commissioner of Patents and Trademarks*

*Attesting Officer*